US010176671B1

(12) United States Patent
Halvorson

(10) Patent No.: US 10,176,671 B1
(45) Date of Patent: Jan. 8, 2019

(54) GAMING SYSTEM AND METHOD HAVING A SECONDARY SYMBOL AWARD ENHANCEMENT

(71) Applicant: ADP GAUSELMANN GMBH, Espelkamp (DE)

(72) Inventor: Michael Charles Halvorson, Las Vegas, NV (US)

(73) Assignee: adp Gauselmann GmbH, Espelkamp (DE)

( * ) Notice: Subject to any disclaimer, the term of this patent is extended or adjusted under 35 U.S.C. 154(b) by 0 days.

(21) Appl. No.: 15/858,670

(22) Filed: Dec. 29, 2017

(51) Int. Cl.
*G07F 17/34* (2006.01)
*G07F 17/32* (2006.01)

(52) U.S. Cl.
CPC ..... *G07F 17/3244* (2013.01); *G07F 17/323* (2013.01); *G07F 17/3213* (2013.01); *G07F 17/3237* (2013.01); *G07F 17/3258* (2013.01); *G07F 17/34* (2013.01)

(58) Field of Classification Search
None
See application file for complete search history.

(56) References Cited

U.S. PATENT DOCUMENTS 6,056,642 A * 5/2000 Bennett ..... G07F 17/3211 273/143 R
6,641,477 B1 * 11/2003 Dietz, II ..... G07F 17/3265 273/143 R
6,932,702 B1 8/2005 Harris
2002/0022514 A1 * 2/2002 Randall ..... G07F 17/34 463/20
2003/0054874 A1 * 3/2003 Kaminkow ..... G07F 17/3211 463/20
2003/0054875 A1 * 3/2003 Marks ..... G07F 17/32 463/20
2003/0083121 A1 * 5/2003 Cole ..... G07F 17/32 463/16
2005/0037836 A1 * 2/2005 Gilmore ..... G07F 17/32 463/25
2005/0056996 A1 * 3/2005 Nordman ..... G07F 17/3202 273/143 R
2005/0070353 A1 * 3/2005 Webb ..... G07F 17/32 463/16

(Continued)

*Primary Examiner* — Tramar Harper
(74) *Attorney, Agent, or Firm* — Resolute Legal PLLC

(57) ABSTRACT

Various embodiments of a gaming system and method are disclosed as having secondary symbol sets that are used to enhance initial payout awards associated with winning symbol combinations. The gaming system may generate and display one or more symbols from the secondary symbol set in symbol display positions associated with symbols that formed a winning symbol combination. The generated symbols from the secondary symbol set and the symbols that formed winning symbol combinations can be displayed in the same symbol display positions at substantially the same time. In some embodiments, the symbols in the secondary symbol set comprise a plurality of different color symbols, where the color symbols are each associated with awards that may enhance a payout award associated with the winning symbol combination. Thus, generating the secondary symbols in association with the symbol display positions of the winning symbol combination may enhance or improve an initial payout award.

15 Claims, 22 Drawing Sheets

(56) References Cited

U.S. PATENT DOCUMENTS

| | | | | |
|---|---|---|---|---|
| 2006/0073878 | A1* | 4/2006 | Shackelford | G07F 17/3244 463/20 |
| 2006/0121978 | A1* | 6/2006 | Hornik | G07F 17/32 463/20 |
| 2006/0189378 | A1* | 8/2006 | Aoki | G07F 17/3202 463/20 |
| 2007/0087805 | A1* | 4/2007 | Taylor | G07F 17/32 463/16 |
| 2008/0004103 | A1* | 1/2008 | Kojima | G07F 17/32 463/20 |
| 2008/0051187 | A1* | 2/2008 | Iwamoto | G07F 17/32 463/20 |
| 2008/0139293 | A1* | 6/2008 | Sato | G07F 17/32 463/20 |
| 2008/0287179 | A1* | 11/2008 | Berman | G07F 17/34 463/20 |
| 2009/0143135 | A1* | 6/2009 | Yoshizawa | G07F 17/32 463/20 |
| 2009/0203425 | A1* | 8/2009 | Yoshizawa | G07F 17/32 463/20 |
| 2009/0275387 | A1* | 11/2009 | Yoshizawa | G07F 17/3244 463/20 |
| 2013/0217464 | A1* | 8/2013 | Terdina | G07F 17/34 463/20 |

* cited by examiner

600

Color Pay Table

Red = 5x
Blue = 10x
Green = 0
Yellow = 2x
Purple = Freespins
Pink = 200 credits

FIG. 6

GAMING SYSTEM AND METHOD HAVING A SECONDARY SYMBOL AWARD ENHANCEMENT

FIELD OF THE INVENTION

The present disclosure relates to gaming devices.

SUMMARY OF THE INVENTION

Various embodiments of a gaming system and method are disclosed as having secondary symbol sets that are used to enhance initial payout awards associated with winning symbol combinations. In some embodiments, the secondary symbol sets are associated with predetermined positions. In some embodiments, the secondary symbol sets are associated with predetermined positions such as symbol display areas of winning symbol combination along active pay lines. The gaming system may generate and display one or more symbols from the secondary symbol set in symbol display positions associated with generated symbols that formed a winning symbol combination. The generated symbols from the secondary symbol set and the generated symbols that formed winning symbol combinations can be displayed in the same symbol display positions at substantially the same time. In some embodiments, the symbols in the secondary symbol set comprise a plurality of different color symbols, where the color symbols are each associated with awards that may enhance a payout award associated with the winning symbol combination. Thus, generating the secondary symbols in association with symbol display positions or symbols of the winning symbol combination may enhance or improve an initial payout award.

In one embodiment, if the gaming system generates a winning symbol combination, the gaming system may also generate a payout award enhancement associated with the winning symbol combination. For example, the gaming system randomly generates and displays a plurality of symbols from a first symbol set that includes one winning symbol combination. The gaming system determines a first payout amount based on the winning symbol combination. The gaming system also determines whether the winning symbol combination triggers a payout award enhancement process. If the winning symbol combination triggers the payout award enhancement process, the gaming system randomly generates a secondary symbol from a secondary symbol set. The gaming system associates the secondary symbol with one of the symbols in the winning symbol combination. The gaming system also displays the generated secondary symbol with the associated symbol in the winning symbol combination. The gaming system evaluates the secondary symbol for an associated payout award enhancement. The gaming system determines a second payout award based on the first payout award and the payout award enhancement. In some embodiments, the payout award enhancement is an award multiplier. Thus, the gaming system may multiply the first payout award by the award multiplier to determine the second payout award.

In one embodiment having a payout award enhancement, the gaming system randomly generates and displays a plurality of symbols from at least one first symbol set. The gaming system evaluates if the generated first plurality of symbols includes any winning symbol combinations. The gaming system determines a first payout amount based on any winning symbol combinations. If the gaming system determined that at least one winning symbol combination was generated, the gaming system also evaluates whether the at least one winning symbol combination triggers a payout award enhancement process. If the at least one winning symbol combination triggers the payout award enhancement process, the gaming system randomly generates at least one secondary symbol from at least one secondary symbol set. The gaming system associates the at least one secondary symbol with one of the symbols in the at least one winning symbol combination. The gaming system also displays the generated secondary symbol with the at least one associated symbol of the at least one winning symbol combination. The gaming system evaluates the generated at least one secondary symbol for an associated payout award enhancement. The gaming system determines a second payout award based on the first payout award and the payout award enhancement.

In one embodiment, a gaming system may include a plurality of symbol display areas associated with a plurality of video based slot machine reels. For example, the gaming system may include five video based slot machine reels (hereafter video reels, virtual reels, or virtual video reels) that are each associated with three symbol display areas. The gaming system further includes a plurality of first symbol sets that each include a first plurality of symbols. Each of the plurality of first symbol sets is associated with one of the reels. For each of the reels, the gaming system generates a plurality of symbols from one of the plurality of first symbol sets. The generated plurality of symbols are displayed on the associated reels in the plurality of symbol display areas of the reels. The gaming system evaluates the generated plurality of symbols for winning symbol combinations. If the gaming system determined that winning symbol combinations were generated, the gaming system determines a first payout amount based on the winning symbol combinations. For example, if the gaming system generated three Cherry symbols along an active pay line, the gaming system determines a first payout amount for the three Cherry symbols in accordance with a pay table of the gaming system.

The gaming system also evaluates the game state for triggers that cause the gaming system to active a payout award enhancement process. For example, the gaming system evaluates the winning symbol combination of three Cherry symbols to determine whether to activate the payout award enhancements. In some embodiments, any winning symbol combination will trigger the payout award enhancements. In other embodiments, certain types of winning symbol combinations are required to trigger the payout award enhancements. In still other embodiments, other triggering events may be used to trigger the payout award enhancements.

If the winning symbol combination of three Cherry symbols trigger the payout award enhancement process, the gaming system randomly generates at least one secondary symbol from at least one secondary symbol set. For example, the gaming system may include a color symbol set as the at least one secondary symbol set. The color symbol set may include (but is not limited to) a plurality of different color symbols such as a Red symbol, a Green symbol, a Blue symbol, and a Yellow symbol. In some embodiments, each of the color symbols is associated with a payout award enhancement, such as 2× for the Red symbol, 5× for the Green symbol, 10× for the Blue symbol, and 1× for the Yellow symbol.

In one embodiment, the gaming system randomly generates at least one color symbol from the color symbol set, such as the Blue symbol. The gaming system associates the Blue symbol with one or more of the symbol display areas of Cherry symbols from the winning Cherry symbol combination. The gaming system also displays the Blue Symbol with the associated Cherry symbols. In some embodiments, the gaming system cycles through and displays each of the color symbols of the secondary symbol set in the symbol display area(s) of the associated Cherry symbols during the random generation of color symbols. For example, the different color symbols may be displayed behind or on top of the associated Cherry symbols. The color symbols can be displayed for a short period of time and appear to flash in the symbol display areas. Alternatively, the color symbols can be displayed for a long period of time in the symbol display areas. The gaming system eventually stops cycling through the color symbols and displays the generated symbol (e.g., the Blue symbol) in the symbol display areas of the associated Cherry symbols. It should be appreciated that the generated color symbol may be selected before or while the gaming system displays the cycling color symbols. The gaming system evaluates the Blue symbol for an associated payout award enhancement. In this example, the gaming system determines that the Blue symbol is associated a 10× payout award enhancement based on a payout award enhancement pay table. The gaming system determines a second payout award based on the first payout award associated with the winning Cherry symbols and the 10× payout award enhancement associated with the Blue symbol.

In some embodiments, the same generated color symbol is displayed in each of the associated symbol display areas of the winning symbol combination (e.g., in the same symbol display areas as the winning combination of Cherry symbols). In such an embodiment, the gaming system may use one payout award enhancement to calculate the second payout award. In another embodiment, the gaming system may use one payout award enhancement per associated winning symbol to separately calculate the second payout award. For example, if one Blue symbol was associated with each of the three winning Cherry symbols, the gaming system may calculate the second payout award by separately multiplying the first award by each of the 10× multipliers and adding the results for the second payout award. It should be appreciated that the gaming system may only generate one Blue symbol and only display the one Blue symbol in association with one of the symbol display positions that displays the Cherry symbols of the winning symbol combination in one embodiment. In such an embodiment, only one 10× multiplier would be used to calculate the second payout award.

In some embodiments, each symbol display area of the winning symbol combination is associated with its own color symbol set. In such embodiments, the gaming system may generate a the same or a different color for each of the symbol display areas of a winning symbol combination. For example, for each of the three Cherry symbols in the winning symbol combination, the gaming system may generate a color symbol from three different color symbol sets. Thus, the generated color symbols between the three Cherry symbols could be the same or different colors. For example, one Cherry symbol could be associated with a Red symbol, a second Cherry symbol could be associated with a Blue symbol, and a third Cherry symbol could be associated with a Green symbol. In one such embodiment, the gaming system may determine the second award by multiplying the first award by the 2× (the Red symbol), 10× (the Blue symbol), and 5× (the Green symbol). Thus, if the first payout award is 20 credits, the payout award enhancement would result in a 2000 credit payout award. In another embodiment, gaming system may determine the second payout award by individually multiplying the first payout award by each payout award enhancement and adding the resulting products (e.g., (20 credits×2)+(20 credits×10)+(20 credits×5)=340 credits for the second payout award).

In some embodiments, upon triggering the payout award enhancement with a winning symbol combination, the gaming system generates a border around one or more of the symbols of the winning symbol combination. In some embodiments, the border is continuous. In other embodiments, the border is segmented. In an embodiment where the border is continuous, the gaming system displays the color symbols in the border area as discussed in connection with the above example. In an embodiment where the border is segmented, the gaming system may use each of the segments to display a different color symbol. In different embodiments, the gaming system can cycle through (display) the color symbols in the continuous border area or the segmented border area at different predetermined speeds.

In some embodiments, different pay lines are associated with different secondary symbol sets. For example, a diagonal pay line may be associated with a first color symbol set of Red, Green, and Blue whereas a horizontal pay line may be associated with a second color symbol set of Yellow, Pink, and Brown. In some embodiments, different color symbols are associated with different probabilities of being generated. In some embodiments, a color symbol can be associated with different probabilities of being generated depending on the pay line.

It should therefore be appreciated that a gaming system and method with secondary symbols to enhance payout awards creates new and exciting ways for a player to improve awards associated with winning symbol combinations. The ability to enhance low payout awards or further improve large payout awards creates a new potential to earn greater awards and improves the sense of anticipation for players using the gaming system and method.

BRIEF DESCRIPTION OF THE DRAWINGS

FIG. 6 illustrates one embodiment of a pay table for a secondary symbol award enhancement.

DETAILED DESCRIPTION OF THE INVENTION

Figure 1:
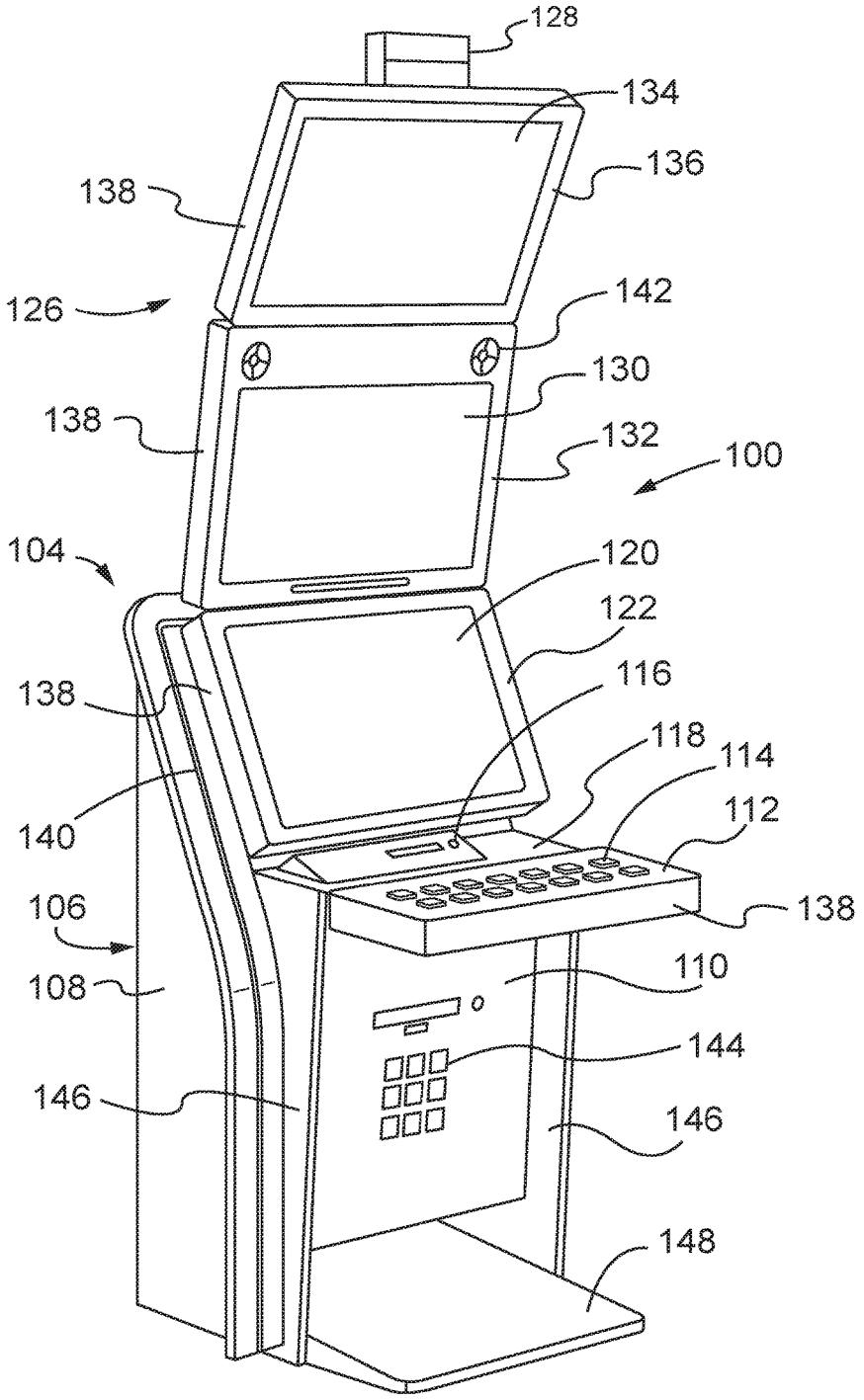
FIG. 1 is a perspective view of one embodiment of a stand-alone gaming device of a gaming system.

Various embodiments of a gaming system and method are disclosed as having secondary symbol sets that are used to enhance initial payout awards associated with winning symbol combinations. In some embodiments, the secondary symbol sets are associated with predetermined positions. In some embodiments, the secondary symbol sets are associated with predetermined positions such as symbol display areas of winning symbol combination along active pay lines. The gaming system may generate and display one or more symbols from the secondary symbol set in symbol display positions associated with generated symbols that formed a winning symbol combination. The generated symbols from the secondary symbol set and the generated symbols that formed winning symbol combinations can be displayed in the same symbol display positions at substantially the same time. In some embodiments, the symbols in the secondary symbol set comprise a plurality of different color symbols, where the color symbols are each associated with awards that may enhance a payout award associated with the winning symbol combination. Thus, generating the secondary symbols in association with the symbol display areas or symbols of the winning symbol combination may enhance or improve an initial payout award.

In one embodiment, if the gaming system generates a winning symbol combination, the gaming system may also generate a payout award enhancement associated with the winning symbol combination. For example, the gaming system randomly generates and displays a plurality of symbols from a first symbol set that includes one winning symbol combination. The gaming system determines a first payout amount based on the winning symbol combination. The gaming system also determines whether the winning symbol combination triggers a payout award enhancement process. If the winning symbol combination triggers the payout award enhancement process, the gaming system randomly generates a secondary symbol from a secondary symbol set. The gaming system associates the secondary symbol with one of the symbols in the winning symbol combination. The gaming system also displays the generated secondary symbol with the associated symbol in the winning symbol combination. The gaming system evaluates the secondary symbol for an associated payout award enhancement. The gaming system determines a second payout award based on the first payout award and the payout award enhancement. In some embodiments, the payout award enhancement is an award multiplier. Thus, the gaming system may multiply the first payout award by the award multiplier to determine the second payout award.

In one embodiment having a payout award enhancement, the gaming system randomly generates and displays a plurality of symbols from at least one first symbol set. The gaming system evaluates if the generated first plurality of symbols includes any winning symbol combinations. The gaming system determines a first payout amount based on any winning symbol combinations. If the gaming system determined that at least one winning symbol combination was generated, the gaming system also evaluates whether the at least one winning symbol combination triggers a payout award enhancement process. If the at least one winning symbol combination triggers the payout award enhancement process, the gaming system randomly generates at least one secondary symbol from at least one secondary symbol set. The gaming system associates the at least one secondary symbol with one of the symbols in the at least one winning symbol combination. The gaming system also displays the generated secondary symbol with the at least one associated symbol of the at least one winning symbol combination. The gaming system evaluates the at least one secondary symbol for an associated payout award enhancement. The gaming system determines a second payout award based on the first payout award and the payout award enhancement.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players.

Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
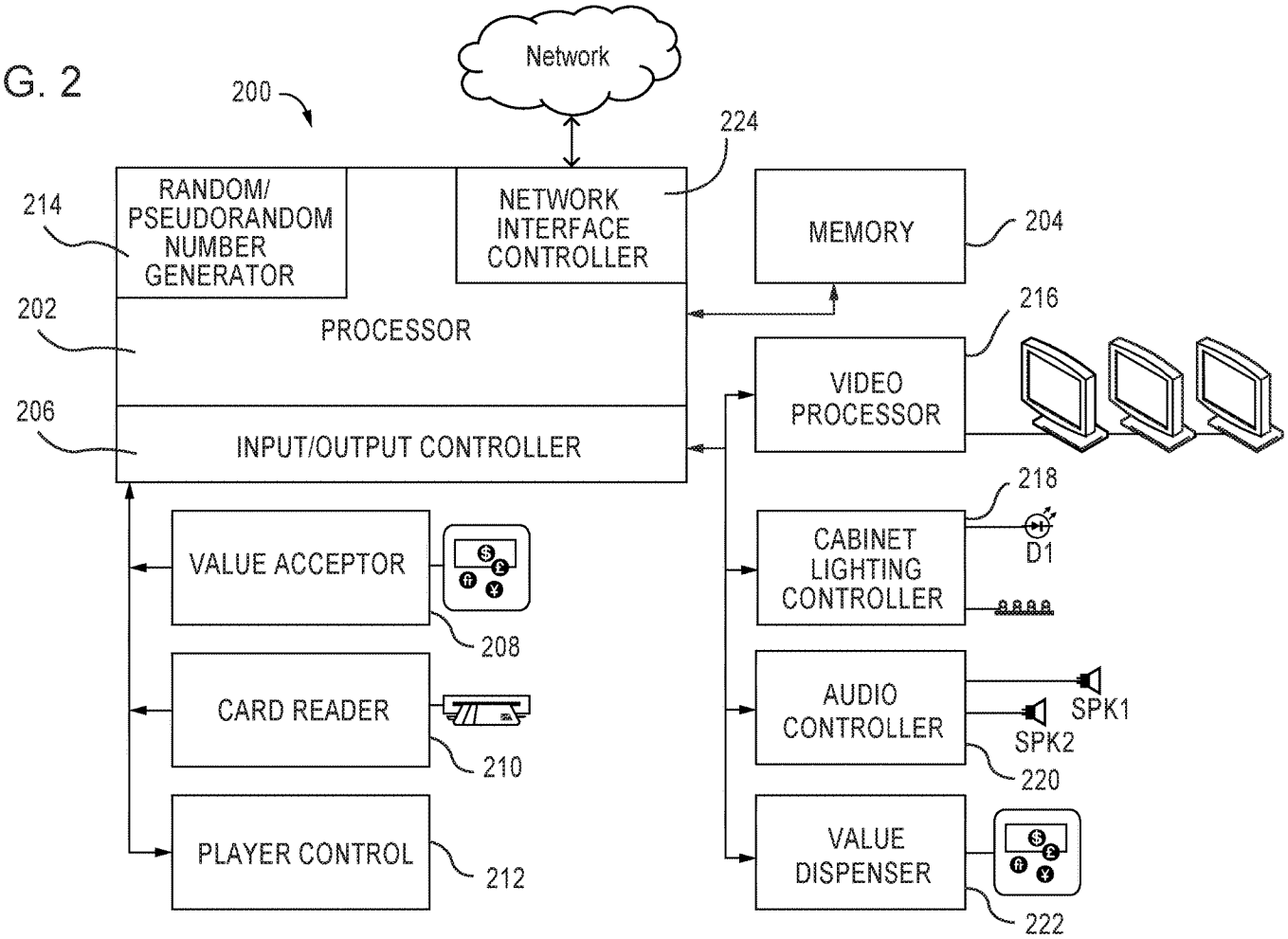
FIG. 2 is a functional block diagram of the gaming device technology components of the gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

In one embodiment, the gaming device 100 may utilize any combination of memory devices such as random access memory devices (RAMs), unalterable memory devices (ROMs), and mass storage devices for securely storing and securely communicating the software components or code that facilitate game play and other functions of the gaming device 100. The memory devices may store software components or code that include various game data and game related control and execution software. In some embodiments, the software components stored in the memory devices may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the gaming device 100.

In some embodiments, the memory devices, such as memory device 204, with the software components and other data may be secured and authenticated by authentication software stored in an unalterable memory device within the housing of gaming device 100. The gaming device 100 may also include application specific integrated circuits (ASICs) to perform the security and authentication functions. At any appropriate time, such as before each play of a game, at a predetermined interval, upon transfer of any game data or any software components from a mass storage to memory device 204, or upon demand, the gaming device 100 (using a processor such as processor 202 or a separate ASIC) may execute an authentication routine and perform an authentication of any software component or other data of the gaming device 100. In one embodiment, the gaming device software components may be prepared for authentication via creation and storage of an encrypted signature unique to one or more of the software components.

In one embodiment, an encrypted signature may be created by utilizing a hash function on a software component or code to form a message digest (i.e., a hash of the software component) followed by a key encryption of the message digest to form an encrypted signature unique to the software component. In some embodiments, the key encryption may be public key encryption, private key encryption, or any suitable key encryption schema. The encrypted signature may be stored with the gaming device software component, for example, in a mass storage device or an unalterable memory. During a software component authentication, the gaming device 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and gaming device 100 may allow game play to proceed. However, when the message digests do not match, the gaming device 100 may determine that the software component under authentication may be corrupted or fraudulent and game play may be halted. It should be appreciated that the gaming device 100 may perform other suitable security and authentication checks on the game data or software components. Such authentication and security devices and functions are unique to gaming and casino industry to minimize or prevent fraud in gaming devices and gaming systems.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. In some embodiments, the random selection of one or more game symbols is represented by spinning reels in a virtual video reel slot machine game (however any suitable game can be used). As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202.

In yet another embodiment, random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The reels can be set into a spinning/rotation motion by pulling a lever or pushing a button. In some embodiments, the gaming device 100 can stop the reels by the gaming device 100 actuating, on a random timing basis, a suitable mechanical or electro-mechanical reel brake. When the reels stop rotating, one or more displayed stop positions of each reel is detected. Since the stop positions are each associated with an indicia or symbol, the gaming device can determine whether the combination of stop positions (i.e., translating to a combination of displayed symbols) results in a winning symbol combination.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Gaming System Including Secondary Symbol Award Enhancement

Figure 3A:
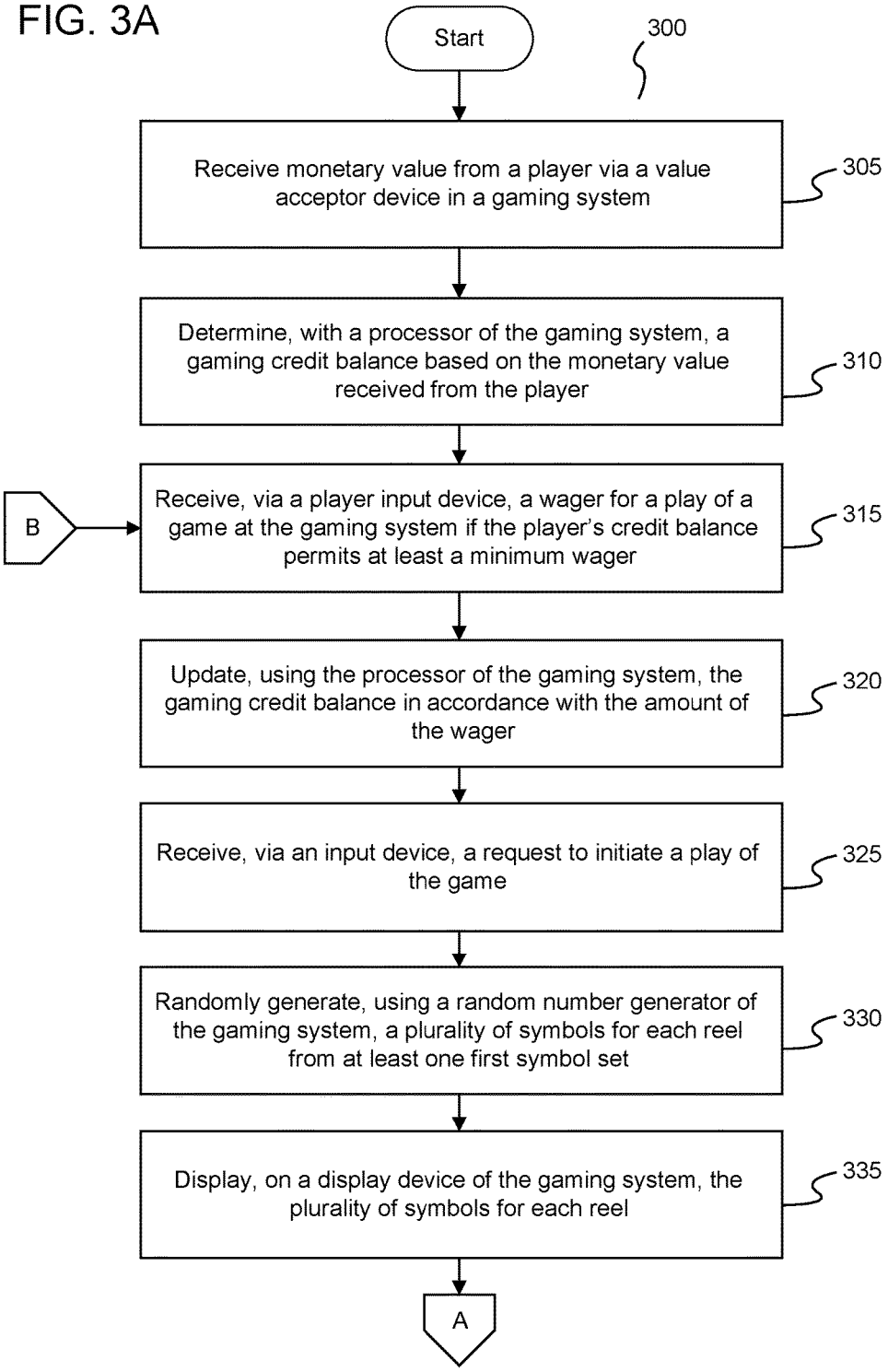
FIGS. 3A and 3B illustrate one embodiment of a method of operating the gaming system comprising a secondary symbol award enhancement.
Figure 3B:
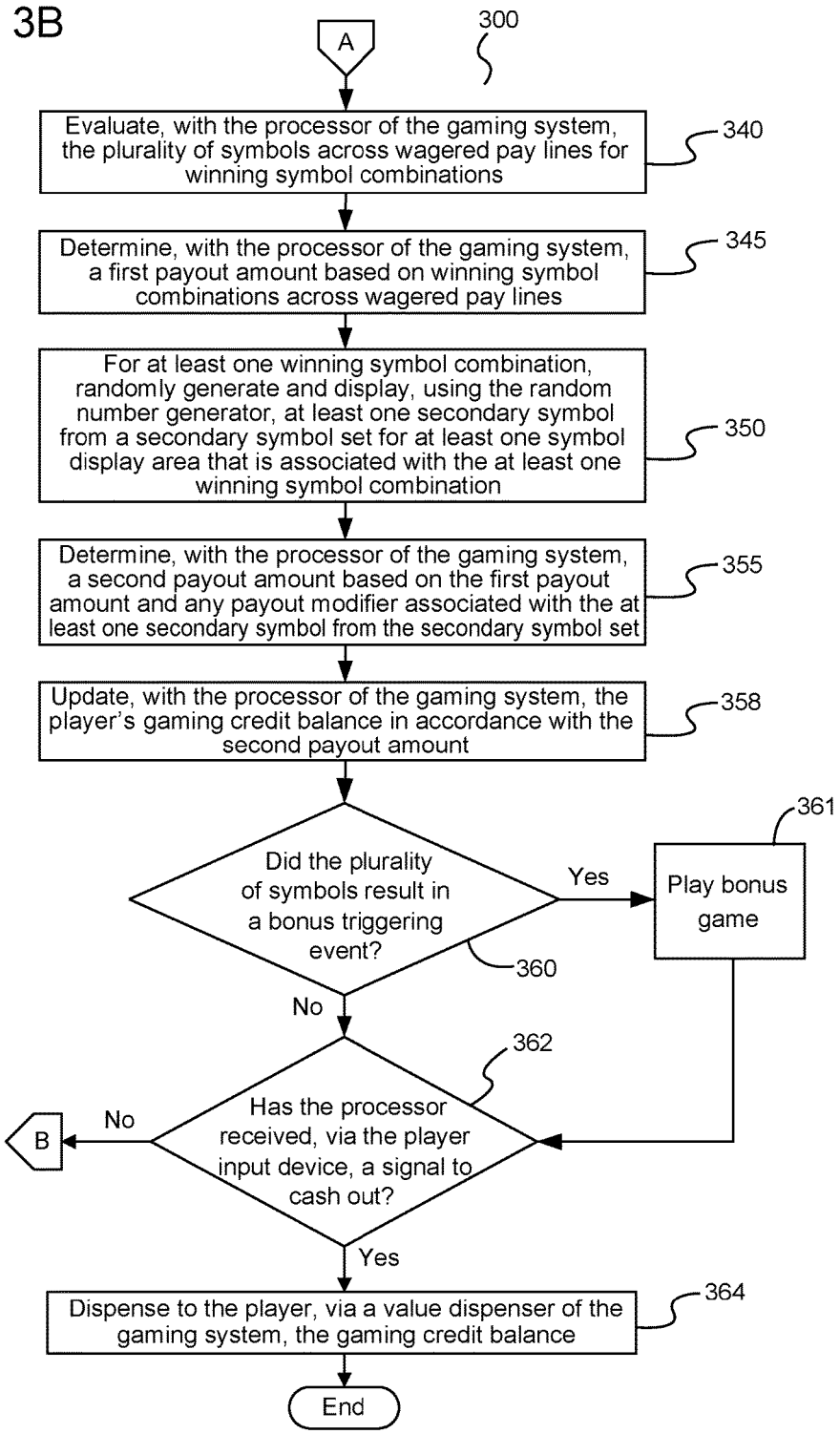

FIGS. 3A and 3B illustrate a flowchart of an example operation 300 of one embodiment of the gaming system and method. FIGS. 3A and 3B are depicted as a base or primary game. However, it should be appreciated that some of the features discussed in connection with FIG. 3B may be separated into a distinct bonus game. In some embodiments, the features discussed in connection with FIG. 3B may be used in both a primary game and a bonus game.

In one embodiment, a processor of the gaming system is configured, via instructions stored in a memory device, to perform the operation 300. However, it should be appreciated that other suitable variations of operation 300 are possible. For example, in one embodiment, fewer or one or more additional blocks (not shown) may be employed in operation 300 of the gaming system and method. In other embodiments, the blocks may be performed in any suitable order.

FIG. 3A illustrates one embodiment in which the gaming system receives a monetary value from a player to initiate operation 300. As indicated in block 305, the gaming system may receive monetary value via a value acceptor device associated with the gaming system. The value acceptor device, in one embodiment, is disposed in a gaming system or in communication with the gaming system as discussed above.

In one embodiment, the gaming system determines a credit balance based on the monetary value received from the player at a value acceptor device as indicated in block 310. The gaming system determines, via a processor, a gaming credit balance for the player. The gaming credit balance may be based on the monetary value received from the player at the value acceptor device.

In one embodiment, the gaming system may receive a wager for a play of a game at the gaming system. Block 315 of FIG. 3A illustrates one embodiment where the player's wager is received via a player input device. The gaming system may allow a player to place a minimum wager, a maximum wager, or any suitable wager amount. Depending on the wager amount, the gaming system may also enable the player to select pay lines across displayed symbol positions on reels in a game in which to place wagers in one embodiment. In some embodiments, the gaming system selects the wagered pay lines automatically based on the player's wager. Wagered pay lines may be referred to herein as active pay lines. In one embodiment, the gaming system may determine whether the player provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system.

In one embodiment, the gaming system may use a processor of the gaming system to update a gaming credit balance. The credit balance may be updated in accordance with the player's wager amount as indicated in block 320. Some embodiments, the credit balance is not updated until a later time.

Block 325 illustrates one embodiment in which the gaming system may receive a request to initiate a play of a game. The request to initiate the play of the game may be received from a player via a player input device in communication with the gaming system. The gaming system may securely access game data from a memory device and execute an authentication routine on the game data to start a play of a game as discussed above. For example, the player may press a spin button on the gaming system to start spinning slot machine reels of the gaming system (or randomly generating symbols using other methods discussed above for video reels or virtual reels) for the play of the game. It should be appreciated that reels used throughout the specification may refer to mechanical reels, electro-mechanical reels, or video reels (where virtual reels strips or no reel strips are used). It should further be appreciated that although many examples illustrated in the specification describe the games in terms of slot machines with reels, other games may be used, including games without slot machine reels.

In one embodiment, the gaming system may use a random number generator to randomly generate a plurality of symbols from at least one first symbol set as indicated in block 330. In one embodiment, at least some of the symbols in the symbol set are classified or associated with a symbol type. In some embodiments, the gaming system may generate the plurality of symbols for display on a set of reels. As used herein, the random generation or random number generation may refer to pseudo-random or true-random number generation depending on the module used for the random number generation. In some embodiments of a reel game, the gaming system generates a symbol for each symbol display area on each reel from at least one symbol set. In some embodiments, each reel is associated with a different first symbol set. The different first symbol sets may comprise the same sets of different symbols (e.g., all first symbol sets comprise Cherry symbols, Grape symbols, King symbols, Queen symbols, Bar symbols, etc.), where the same symbol across the different first symbol sets is associated with the same probability of being selected. In some embodiments, the different first symbol sets may comprise different sets of different symbols. It should be appreciated that any suitable arrangement of symbols across the first symbol sets may be used.

In one embodiment, the gaming system may cause a display device to display the plurality of symbols generated as indicated in block 335. In a game using reels, the gaming system may display the generated plurality of symbols in visible symbol display areas of each of the reels. Off page connector A refers to FIG. 3B to continue operation 300.

Turning now to FIG. 3B and off page connector A, in one embodiment as shown in block 340, the gaming system evaluates the generated plurality of symbols across active or wagered pay lines for winning symbol combinations. In some embodiments, the gaming system evaluates the winning symbol combinations based on the pay lines wagered upon by a player. The gaming system may evaluate the player selected pay lines, gaming system assigned pay lines, or pay lines assigned as active in some other manner for the play of the game. In one embodiment, the gaming system determines an award amount based on winning symbol combinations formed across the reels on active pay lines. For example, if a pay table associated with the gaming system indicated that at least three of the same Bar symbols is a winning symbol combination and awards a predetermined payout value, the gaming system would evaluate the generated plurality of symbols for three of the same Bar symbols. If the gaming system generated at least three of the same Bar symbols on adjacent reels and along an active pay line, the gaming system may determine that the three Bar symbols form a winning symbol combination based on the pay table. It should be appreciated that the pay table may include any suitable number of different winning symbol combinations and payouts. In one embodiment, the pay table may indicate that as few as one symbol may be associated with a payout. Alternatively, two or more symbols may be used to form winning symbol combinations that result in a payout. The gaming system may generate one or more winning symbol combinations.

In block 345, the gaming system determines, with the processor, a first payout amount (or first payout award) based on the evaluated winning symbol combinations across active pay lines. The gaming system may update, with the processor, the player's gaming credit balance in accordance with any award amount associated with all of the winning symbol combinations. As noted above, the blocks illustrated in FIGS. 3A and 3B can be rearranged in any suitable order. As such, it should be appreciated that the gaming system may update player's gaming credit balance at other suitable times, especially where the gaming system may enhance the first payout amount.

In one embodiment, as indicated in block 350, for at least one winning symbol combination, the gaming system may randomly generate, using the random number generator, a secondary symbol from a secondary symbol set. The secondary symbol set comprises a plurality of different symbols. In one embodiment, the plurality of different symbols comprise different color symbols. However, any suitable symbol may be used for the secondary symbol set.

In one embodiment, the gaming system activates the random generation of the secondary symbol based on a triggering event. In some embodiments, the triggering event may comprise one or more winning symbol combinations. In some embodiments, the triggering event is a predetermined winning symbol combination. In some embodiments, the triggering event is predetermined winning symbol combination on a predetermined active pay line. However, any suitable triggering event can be used to cause the gaming system to activate the random generation of the secondary symbol.

The gaming system associates the generated secondary symbol with a symbol display area of one of the symbols from the winning symbol combination. As also indicated in block 350, the gaming system also displays the generated secondary symbol in the associated symbol display area. In one embodiment, the gaming system displays the generated secondary symbol behind the symbol from the winning symbol combination in the associated symbol display area. In one embodiment, the gaming system displays the generated secondary symbol on top of the symbol from the winning symbol combination in the associated symbol display area. In one such embodiment, the opacity of the generated secondary symbol is reduced such that the symbol from the winning symbol combination is still visible with the generated secondary symbol. In some embodiments, the symbol from the winning symbol combination and the generated secondary symbol are displayed together in the symbol display area at substantially the same time. Thus, it should be appreciated that the generated secondary symbol can be displayed with the symbol from the winning symbol combination without removing the symbol from the winning symbol combination.

In some embodiments, the gaming system cycles through and displays each of the secondary symbols of the secondary symbol set in the associated symbol display area during the random generation of the secondary symbol. For example, where the secondary symbols are different color symbols, the gaming system may display a plurality or each of the color symbols in the associated symbol display area (e.g., behind the symbol from the winning symbol combination, on top of the symbol from the winning symbol combination, in some segment of the symbol display area, etc.) before, during, or after the gaming system generates the secondary symbol. The secondary symbols from the secondary symbol set can be displayed for a short period of time in the associated symbol display area and appear to flash in the symbol display area. Alternatively, the secondary symbols can be displayed for a long period of time in the symbol display area. The secondary symbols can also be displayed for varying amounts of time to enhance the anticipation of revealing the final secondary symbol selection in some embodiments. The gaming system eventually stops cycling through the secondary symbols and displays the generated secondary symbol in the associated symbol display area. It should be appreciated that the generated or finally selected secondary symbol may be generated before or while the gaming system displays the cycling secondary symbols from the secondary symbol set(s) in the associated symbol display area.

In one embodiment, the generated secondary symbol is associated and displayed with each of the symbol display areas of the symbols from the winning symbol combination. Thus, in one such embodiment, the gaming system display the same secondary symbol in all of the associated symbol display areas of the winning symbol combination. In some embodiments, the generated secondary symbol is associated symbol display areas, where the symbol display areas are associated with symbols in a winning symbol combination.

In one embodiment, the gaming system may generate a plurality of different secondary symbols from the secondary symbol set. The gaming system may associate each of the generated plurality of secondary symbols with a symbol display area of one of the symbols from the winning symbol combination. Thus, in one such embodiment, the gaming system may display different secondary symbols in the associated symbol display areas of the winning symbol combination. It should also be appreciated that some, but not all of the symbol display areas of the winning symbol combination may be associated with a generated one of the plurality of different secondary symbols.

In an alternative embodiment, the gaming system generates a secondary symbol from the secondary symbol set for each symbol display areas of the winning symbol combination. Thus, it should be appreciated that the gaming system may generate the same or different secondary symbols for each of the different symbol display areas associated with the winning symbol combination.

Thus, it should be appreciated that the generated secondary symbols are associated with symbol positions rather than with particular symbols in some embodiments, while in other embodiments, the generated secondary symbols are associated with symbols of winning symbol combinations. The different between such associations may change how the gaming system calculates payout award enhancements.

In some embodiments, the gaming system comprises a plurality of secondary symbol sets. In some such embodiments, the plurality of secondary symbol sets include the same set of different symbols. In some embodiments, the plurality of secondary symbol sets include different sets of different symbols. In an embodiment with a plurality of secondary symbol sets, each symbol display area associated with a symbol in a winning symbol combination may also be associated with one of the plurality of secondary symbol sets. Thus, the gaming system may generate secondary symbols from different secondary symbol sets for different symbol display areas.

In some embodiments, different pay lines are associated with different secondary symbol sets. For example, a diagonal pay line may be associated with a first secondary symbol set whereas a horizontal pay line may be associated with another different secondary symbol set. In some embodiments, different secondary symbols are associated with different probabilities of being generated. In some embodiments, a secondary symbol can be associated with different probabilities of being generated depending on the pay line or depending on the associated symbol display area.

Returning to block 355, the gaming system determines, with the processor of the gaming system, a second payout amount based on the first payout amount and any payout modifier associated with the generated at least one secondary symbol from the secondary symbol set. In one embodiment, the gaming system evaluates the generated secondary symbol for an associated payout award enhancement (e.g., a payout modifier). For example, the gaming system analyzes a pay table associated with the secondary symbol set to determine the payout award enhancement associated with the generated secondary symbol. The gaming system thereafter determines the second payout award based on the first payout award and the payout award enhancement. In some embodiments, the payout award enhancement is a payout multiplier (e.g., a 2×, 3×, 10×, etc.). Thus, the second payout award may be calculated by multiplying the first payout award by the payout award enhancement multiplier. In some embodiments, the payout award enhancement comprises a value. Thus, in such an embodiment, the second payout award may be calculated by adding the first payout award with the payout award enhancement value. In other embodiments, the payout award enhancement can be any other suitable award or prize. In some embodiments where a suitable award or prize is not a monetary value or a multiplier, the player may simply collect the first payout amount and collect the award or prize without any calculation.

In block 358, the gaming system updates, with the processor, the player's gaming credit balance in accordance with the second payout award.

While the above discussion has focused on the gaming system generating one winning symbol combination of a plurality of symbols and enhancing the payout award for the one winning symbol combination, it should also be appreciated that the gaming system may generate a plurality of winning symbol combinations. In some embodiments, the gaming system may apply the above discussed payout award enhancement operation (and variations thereof) to one or more of the winning symbol combinations.

In an example with two winning symbol combinations, the gaming system may generate one secondary symbol from one secondary symbol set for one of the winning symbol combinations. The gaming system may generate a plurality of different secondary symbols from a plurality of different secondary symbol sets for the other one of the winning symbol combinations. In addition, one or more of the various combinations of payout award enhancement calculations may be applied to the different winning symbol combinations. Thus, the gaming system may provide a highly varied and exciting payout award enhancement system to players.

Returning to block 360, if the gaming system determined that the generated plurality of symbols did not result in triggering a bonus game, operation 300 moves to block 362.

In one embodiment, as indicated in block 362, the gaming system may receive a signal to end game play or "cash out" via an input device of the gaming system. In such a situation, the gaming system dispenses a value to the player, through a value dispenser, based on the player's gaming credit balance as illustrated in block 364 and operation 300 ends.

On the other hand, if the gaming system processor has not received a signal to end game play via the player input device, the process of operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

Returning to block 360, if the gaming system determined that the generated plurality of symbols resulted in trigging a bonus game, operation 300 moves to block 361. In one embodiment, if the gaming system determines that the generated plurality of symbols includes one or more generated predetermined symbols, the gaming system will trigger or activate the bonus game. In one embodiment, the predetermined symbol is a symbol that serves one function: to trigger the bonus game. In alternative embodiments, the predetermined symbol serves a plurality of game functions, such as triggering the bonus game and providing an award value. Other suitable game functions may be associated with the predetermined symbol. In some embodiments, generating different quantities of the predetermined symbol cause the gaming system to trigger different bonus game features.

Moving to block 361, the gaming system may be configured to play any suitable bonus game. In one embodiment, the gaming system may be configured to execute the payout award enhancement features discussed above as part of the bonus game. When the bonus game is complete, then operation 300 may proceed to block 362. As indicated in block 362, the gaming system may receive a signal to end game play or "cash out" via an input device of the gaming system. In such a situation, as illustrated in block 364, the gaming system dispenses a value to the player through a value dispenser based on the player's gaming credit balance and operation 300 ends.

On the other hand, if the gaming system processor has not received a signal to end game play via the player input device, the process of operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

FIGS. 4A-4J illustrate screen shots of one embodiment of a gaming system including a secondary symbol award enhancement.

Figure 4A:
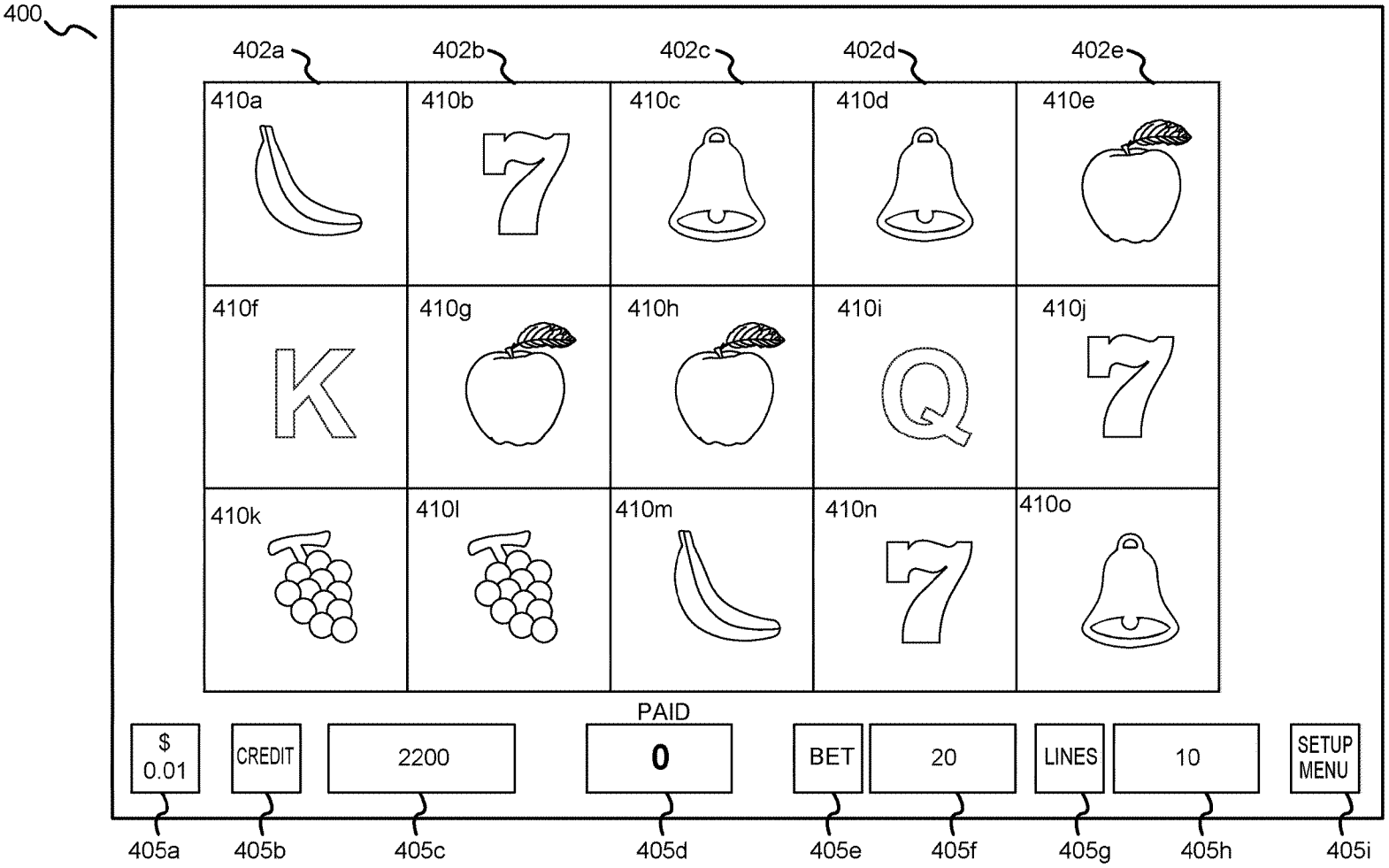
FIGS. 4A, 4B, 4C, 4D, 4E, 4F, 4G, 4H, 4I, and 4J illustrate screen shots of one embodiment of a gaming system comprising a secondary symbol award enhancement.

FIG. 4A illustrates one embodiment of a game display 400 that the gaming device 100 may display on a display device of the gaming system. In one embodiment, game display 400 may be displayed on first display 122 of gaming device 100 illustrated in FIG. 1. However, any other suitable display may be used. The game display 400 displays a set of a plurality of virtual video slot machine reels 402*a*, 402*b*, 402*c*, 402*d*, and 402*e* as illustrated in FIG. 4A for a primary or base game. As also illustrated in FIG. 4A, the reels 402*a*-402*e* are displayed substantially side by side. It should be appreciated that reels 402*a*-402*e* can be displayed with any suitable amount of separation or no separation. It should be appreciated that the game shown in game display 400 is merely representative and may have more or fewer game elements shown in the game display 400. It should also be appreciated that other games may be used for the primary or base game.

The plurality of reels 402*a*-402*e* are each associated with at least one first symbol set, where the at least one first symbol set includes a plurality of symbols. Each reel 402*a*-402*e* is associated with a plurality of symbols of the first symbol set. Each reel 402*a*-402*e* can also be associated with the same or a different plurality of symbol combinations from the first symbol set.

The first symbol set or symbol set may include numbers, letters, geometric figures, symbols, images, character, blank symbols (e.g., the absence of symbols), animations, or any other suitable graphical depiction. The symbols in the symbol set may include pay symbols and special or designated symbols. In one embodiment, the at least one predetermined symbol is a triggering symbol for a bonus game. In one embodiment, at least one predetermined symbol must be generated on the reels to trigger the bonus game. In some embodiments, when the gaming system generates more than one predetermined trigging symbol, the gaming system activates more features in the bonus game than when the gaming system generates one predetermined trigging symbol. In one embodiment, the predetermined triggering symbol may be any one of the symbols in the symbol set. The predetermined triggering symbol may be associated with only one function, but may alternatively be associated with a plurality of different game functions. In some embodiments, each reel is associated with a separate first symbol set. Each of these separate first symbol sets may include a plurality of symbols.

Returning now to FIG. 4A, the game display 400 depicts a plurality of symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, and 410*o*. These plurality of symbol display areas can be associated in a manner that provides the appearance of game reels. It should also be appreciated that the symbol display areas may not be associated with game reels in some embodiments. As illustrated in FIG. 4A, symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, 410*o* are associated in a manner that provides the appearance of a set of five slot machine game reels. In one embodiment, the plurality of symbol display areas that provide the appearance of five game reels may be arranged in a manner that visibly shows three symbol positions of each of the five game reels. For example, the symbol display areas 410*a*-410*o* are each associated with positions on reels 402*a*-402*e*, respectively. As shown in FIG. 4A, symbol display areas 410*a*, 410*f*, and 410*k* are associated with reel 402*a*; symbol display areas 410*b*, 410*g*, and 410*l* are associated with reel 402*b*; symbol display areas 410*c*, 410*h*, and 410*m* are associated with reel 402*c*; and symbol display areas 410*d*, 410*i*, and 410*n* are associated with reel 402*d*; and symbol display areas 410*e*, 410*j*, and 410*o* are associated with reel 402*e*. The arrangement illustrated in the embodiment of FIG. 4A thus creates a visible display area of the reels 402*a*-402*e* comprising three visible symbol positions for each reel. When viewed together, reels 402*a*-402*e* appear like a 3-row by 5-column virtual video reel array in display 400. In other embodiments, smaller or larger visible areas of the reels can be displayed. That is, the reels 402*a*-402*e* may show fewer or a larger number of visible symbol display areas. While symbol display areas are illustrated with defined boxes, it should be appreciated that in some embodiments, the defined boxes are not visible to the player. It should also be appreciated that in some embodiments, the symbol display areas are other shapes or not predefined (e.g., the symbol display area is defined simply by the shape of a displayed symbol).

Each reel 402*a*-402*e* may display a plurality of symbols that the gaming system generates from the first set or first sets of symbols in their respective symbol display areas as illustrated in FIG. 4A. In one embodiment, the reels may be shown spinning in one direction to simulate slot machine reels. However, it should be appreciated that the reels may be shown spinning in any suitable direction. The reels may also be shown spinning in different directions in some embodiments.

Game display 400 also includes several information areas and buttons 405*a*-405*i*. These information areas and buttons 405*a*-405*i* are illustrated in a particular arrangement, but may be arranged in any suitable manner in different embodiments. In some embodiments, game display 400 may include more or fewer display areas and buttons 405*a*-405*i* than illustrated in FIG. 4A-4H. Information area 405*a* illustrates an example value of one credit for the game displayed in game display 400. Information areas 405*b* and 405*c* illustrate an example of the amount of the player's available credits. Information area 405*d* illustrates the amount of credits a player has won. Because FIG. 4A illustrates the start of a play of a game, the information area 405*d* shows zero credits have been won. Button 405*e* illustrates a software button that the player can select to place a bet or wager. It should be appreciated that the functionality of button 405*e* may also be replicated or replaced with a hardware button on the gaming device 100. Information area 405*f* illustrates that the player has selected to wager 20 credits. Button 405*g* illustrates a software button that the player can select to determine how many pay lines to wager on. It should be appreciated that the functionality of button 405*g* may also be replicated or replaced with a hardware button on the gaming device 100. Information area 405*h* illustrates that the player selected to wager on 10 pay lines. Button 405*i* illustrates a software button that the player can select to obtain information about the game, change certain aspects of the game, obtain help, place an order, etc.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above in information area 405*c*.

To initiate a play of a game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button, a spin button, or a lever. The gaming system may deduct the appropriate credits from the player's credit balance after the wager or at any suitable time.

Figure 4B:
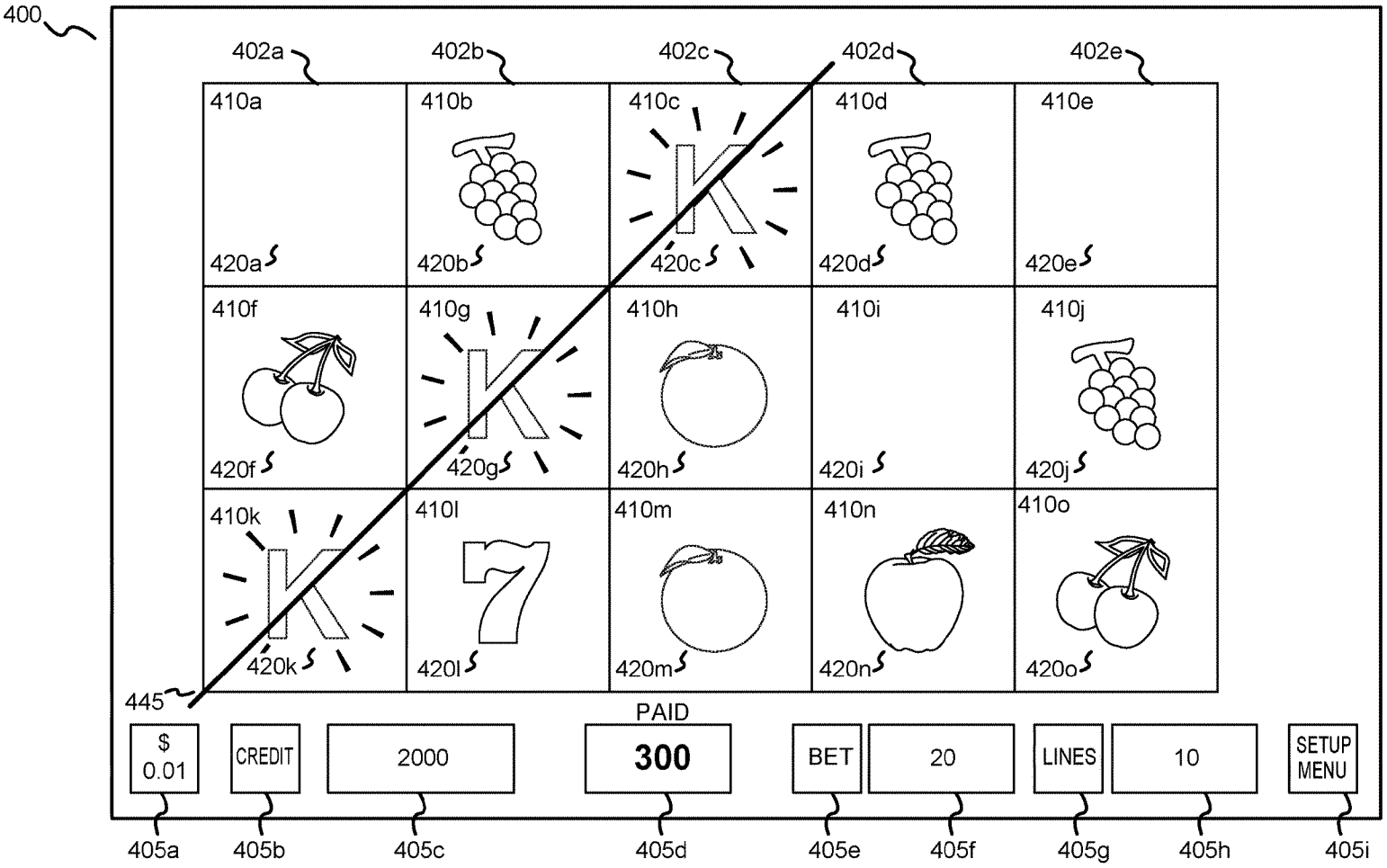

Upon receipt of the player's wager and activation of the game start button, the gaming system may show a display of spinning reels for each of the reels 402*a*-402*e*. The spinning may appear to occur in a vertical top to bottom direction or in a vertical bottom to top direction (not shown), or in a combination of vertical directions (not shown). In one embodiment, the gaming system randomly generates symbols from the first symbol set(s) for reels 402*a*-402*e*, respectively. As noted above, the gaming system may rely on random generation performed by a pseudo RNG, a true RNG, or hardware RNG specifically designed for gaming systems. In one embodiment, the gaming system may also update the player's credit meter (information area 405*c*) to reflect the player's available credit balance. As shown in FIG. 4B, the player's credit meter (information area 405*c*) was decremented by 200 credits from 2200 to 2000 to reflect the 20 credits wager (shown in 405*f*) for each of the 10 active (wagered upon) pay lines (shown in 405*h*) that the player placed for the play of the game.

The gaming system displays the generated symbols 420*a*-420*o* in symbol display areas 410*a*-410*o* as illustrated in FIG. 4B. Symbols 420*a*-420*o* displayed on reels 402*a*-402*e* illustrate the randomly generated symbols from the first symbol set(s) after the reels have stopped spinning. As illustrated in FIG. 4B, the gaming system randomly generated and displayed symbols 420*a*, 420*f*, and 420*k* in symbol display areas 410*a*, 410*f*, and 410*k* for reel 402*a*. The gaming system also randomly generated and displayed symbols 420*b*, 420*g*, and 420*l* in symbol display areas 410*b*, 410*g*, and 410*l* for reel 402*b*; symbols 420*c*, 420*h*, and 420*m* in symbol display areas 410*c*, 410*h*, and 410*m* for reel 402*c*; symbols 420*d*, 420*i*, and 420*n* in symbol display area 410*d*, 410*i*, and 410*n* for reel 402*d*; symbols 420*e*, 420*j*, and 420*o* in symbol display area 410*e*, 410*j*, and 410*o* for reel 402*e*.

As illustrated in FIG. 4B, the gaming system generated and displayed Blank symbols (420*a*, 420*e*, 420*i*), Grape symbols (420*b*, 420*d*, 420*j*), King symbols (420*c*, 420*g*, 420*k*), a Seven symbol (420*l*), Cherry symbols (420*f*, 420*o*), Orange symbols (420*h*, 420*m*), and an Apple symbol (420*n*) in the game display 400. It should be appreciated that the displayed symbol combinations are merely for explanatory purposes and the gaming system may randomly generate any suitable combination of symbols based on defined symbol sets associated with the reels or the symbol display areas.

FIG. 4B further illustrates one embodiment of a gaming system executing an evaluation of the generated symbols on reels 402*a*-402*e* for winning symbol combinations. As noted above, the player may have wagered on one or more pay lines (such as 10 pay lines shown in information area 405*h*). In one embodiment, at least the active (wagered on pay lines) are evaluated for winning symbol combinations. Any suitable number of pay lines may be used to evaluate winning symbol combinations.

In the embodiment illustrated in FIG. 4B, the gaming system evaluated the generated symbol combinations for winning symbol combinations. In FIG. 4B, the gaming system determined that a winning symbol combination is displayed across one wagered pay line 445. The pay line spans across a diagonal direction of symbol display areas including symbol display areas 410*k*, 410*g*, and 410*c*. In this embodiment, the gaming system displayed three King symbols along the diagonal pay line 445 on which the player had placed a wager. The gaming system determined the three King symbols form a winning symbol combination based on a pay table (not shown) associated with the gaming system. The winning pay line is illustrated as pay line 445 in FIG. 4B across the adjacent row of reels 402*a*-402*c*. As also illustrated in FIG. 4B, the gaming system highlighted the King symbols so that the player understands that the player won an award and possibly other game features. It should be appreciated that the gaming system may highlight the symbols in the winning symbol combination in any suitable manner. It should also be appreciated that the gaming system may not highlight the symbols in the winning symbol combination in some embodiments. The gaming system also updated information area 405*d* to illustrate that the player won 300 credits for the winning symbol combination of three King symbols.

As noted in connection with FIG. 3B, the gaming system may evaluate the winning symbol combination to determine if a payout award enhancement process has been triggered. In some embodiments, the gaming system triggers or activates the payout award enhancement process with as little as one winning symbol combination. In some embodiments, the particular symbols (such as King symbols) in the winning symbol combination may cause the gaming system to activate the payout award enhancement process. In some embodiments, the winning symbol combination generated on a particular pay line may cause the gaming system to activate the payout award enhancement process. In some embodiments, the gaming system may preselect particular pay lines such that winning symbol combinations appearing along the preselected pay lines cause the gaming system to activate the payout award enhancement process (e.g., active diagonal pay lines, active horizontal pay lines, etc.). In some embodiments, the gaming system may randomly select one or more pay lines such that winning symbol combinations appearing along the randomly selected one or more pay lines causes the gaming system to activate the payout award enhancement process. In some embodiments, the gaming system randomly determines whether to activate the payout award enhancement process independent of a winning symbol combination appearing along an active pay line. In other embodiments, the gaming system activates the payout award enhancement process based on symbol combinations not appearing along an active pay lines. In still other embodiments, the gaming system determines whether to activate the payout award enhancement process based on the player's wager (e.g., the player may need to place a threshold wager to activate the payout award enhancement process). Some combination of the forgoing may cause the gaming system to determine whether to activate the payout award enhancement process. It should further be appreciated that other suitable criteria may be used to cause the gaming system to activate the payout award enhancement process.

FIGS. 4C-4F illustrate the gaming system cycling through or flashing a plurality of secondary symbols from a secondary symbol set. Each of the secondary symbols is associated with a payout award enhancement. In one embodiment, as illustrated in FIGS. 4C-4F, the plurality of symbols are color symbols. In FIGS. 4C-4F, the secondary symbol set includes color symbols Red, Green, Blue, and Yellow. It should be appreciated that any suitable color and any suitable quantity of different colors may be used. Each of the colors may be associated with a payout award enhancement, although in some embodiments, the payout award enhancement value may result in no enhancement (e.g., 1× or a zero value). In some embodiments, the color symbols are weighted such that the gaming system has a different probability of generating different color symbols. In some embodiments, the color symbols are weighted independent of a pay line or symbols display area. In other embodiments, the color symbols are weighted differently based on the pay line of the winning symbol combination or the associated symbol display areas.

In some embodiments, the color symbols fit within the symbol display areas associated with the winning symbol combination and are displayed in the background of the symbols 420*k*, 420*g*, and 420*c*. However, the color symbols may comprise any suitable shape and can be displayed in other suitable manners with the associated symbol display areas. One alternative example is illustrated in connection with FIGS. 5A-5G. As noted above, the gaming system may have already generated (or selected) the secondary symbol that will be used to determine a payout award enhancement. In other embodiments, the gaming system cycles through the secondary symbols from the secondary symbol set one or some suitable predetermined amount of times (such 5 times) before selecting the secondary symbol that will be used to determine a payout award enhancement. In other embodiments, the gaming system cycles through less than all of the secondary symbols from the secondary symbol set before selecting or displaying the secondary symbol that will be used to determine a payout award enhancement.

Figure 4C:
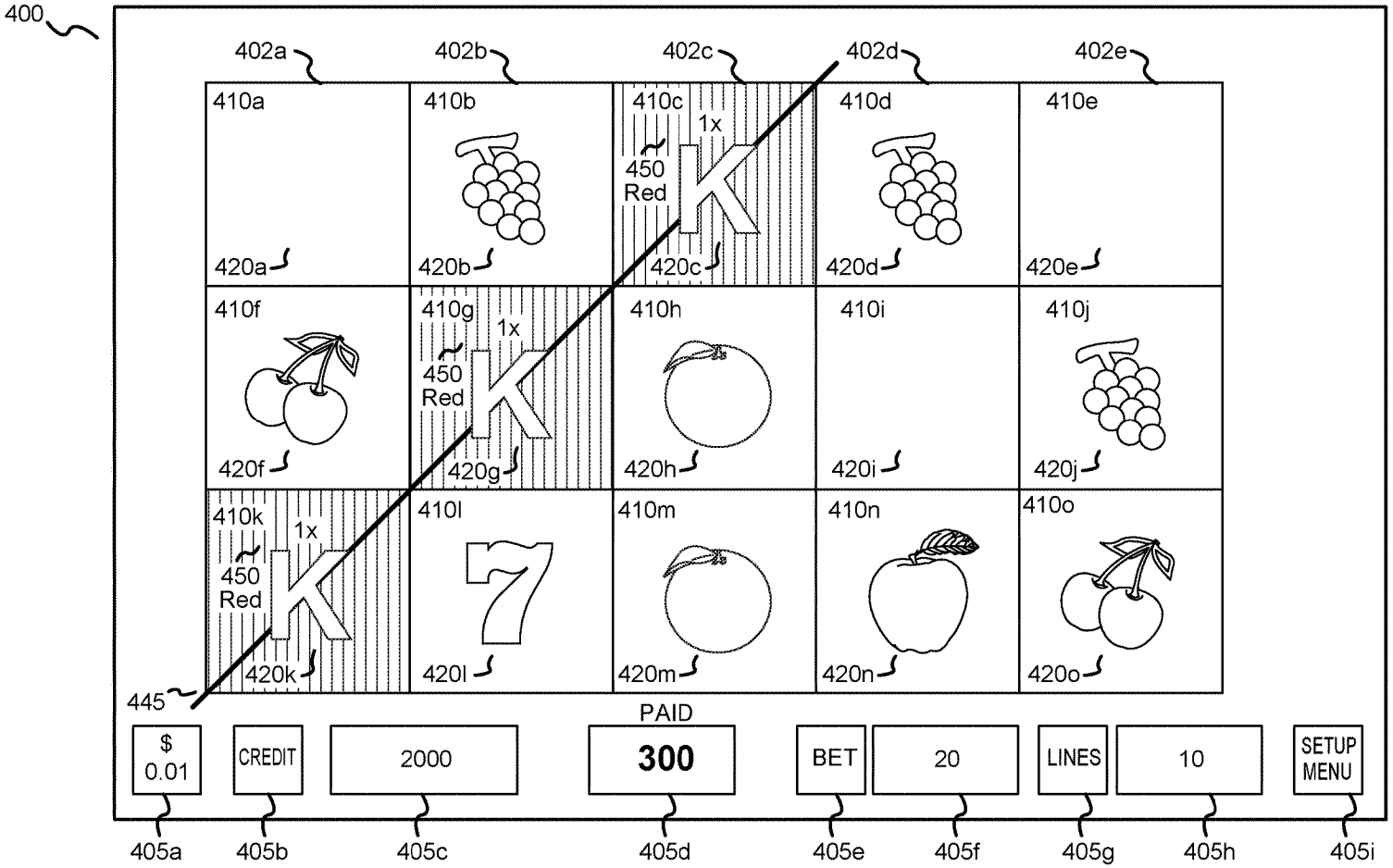

Turning to FIG. 4C, the gaming system begins cycling through the colored symbols from the secondary symbol set. In FIG. 4C, the gaming system first displayed a Red symbol 450 in each of the symbol display areas associated with the winning symbol combination for King symbols. In alternative embodiments, the gaming system may display only one Red symbol 450 in one of symbol display areas 410*k*, 410*g*, and 410*c*, such as in situations where the gaming system uses one payout award enhancement value no matter how many Red symbols 450 are displayed. In other embodiments using a plurality of secondary symbol sets, the gaming system may generate the same or different color symbols for more than one of the symbol display areas 410*k*, 410*g*, and 410*c*. Each of the separately generated color symbols may be used to formulate a second payout award (based on the first payout award of 300 and the payout award enhancement values(s)).

In some embodiments, the gaming system may display the payout award enhancement value associated with the displayed color symbol to excite the player. However, the payout award enhancement value may not be displayed in other embodiments. In some embodiments, the color symbols are displayed for a predetermined period of time (e.g., ½ a second). However any suitable time period can be used. In some embodiments, the time period varies. For example, the color symbols can be displayed for very short periods of time initially, but as the gaming system cycles through the color symbols, the gaming system may begin to increase the amount of time each color symbol is displayed. The gaming system may appear to flash the color symbols in the symbol display areas. It should be appreciated that in some embodiments, the gaming system displays the color symbols at one or more frequencies that will avoid causing seizures in players.

Figure 4D:
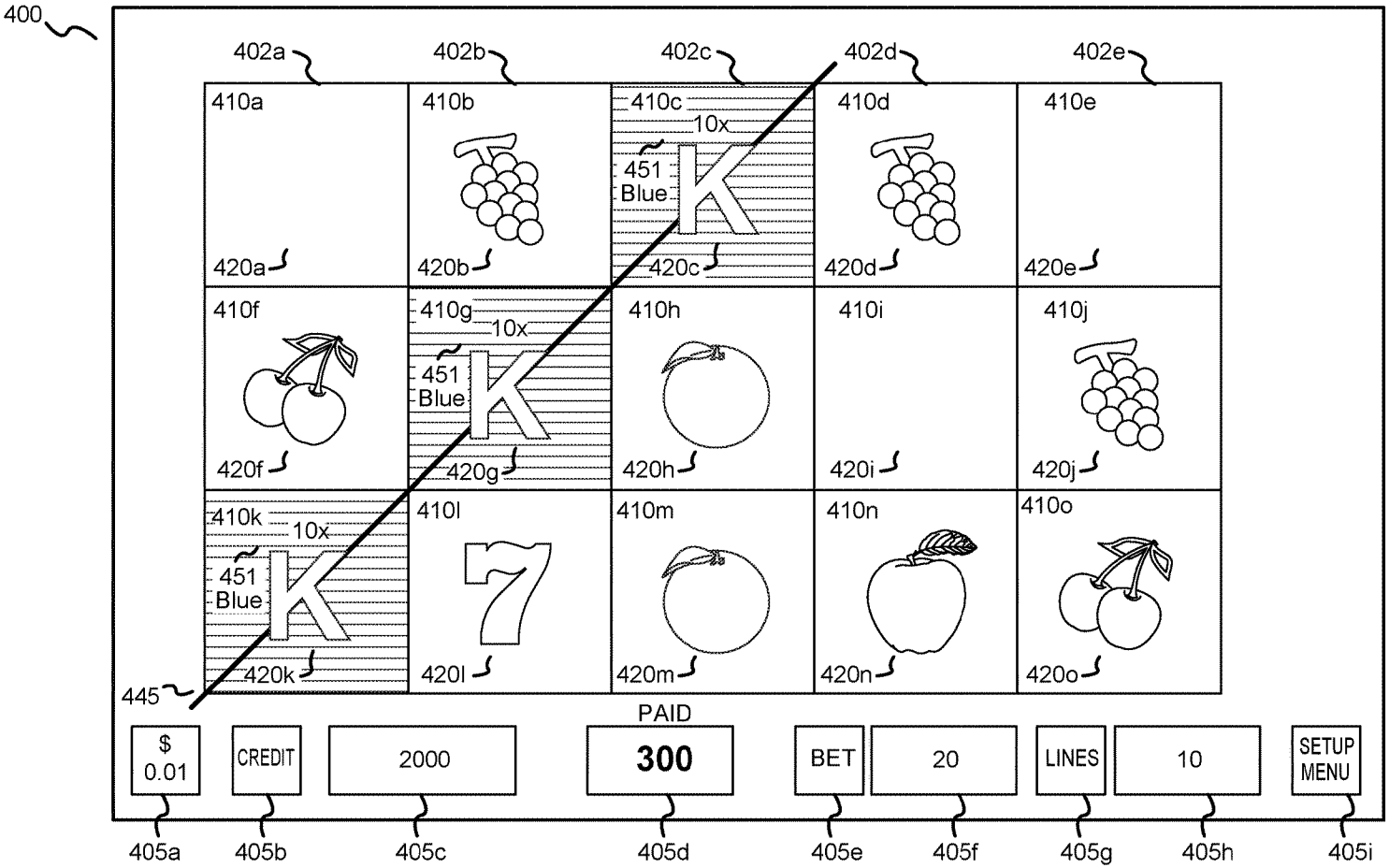

Turning to FIG. 4D, the gaming system continues cycling through the colored symbols from the secondary symbol set. In FIG. 4D, the gaming system replaced the initially displayed Red symbol 450 with Blue symbol 451 in each of the symbol display areas associated with the winning symbol combination for King symbols. It should be appreciated that the color symbols and the King symbols are displayed in the same symbol display areas at substantially the same time. In this embodiment, the Blue symbol 451 is shown associated with a 10× payout award enhancement.

Figure 4E:
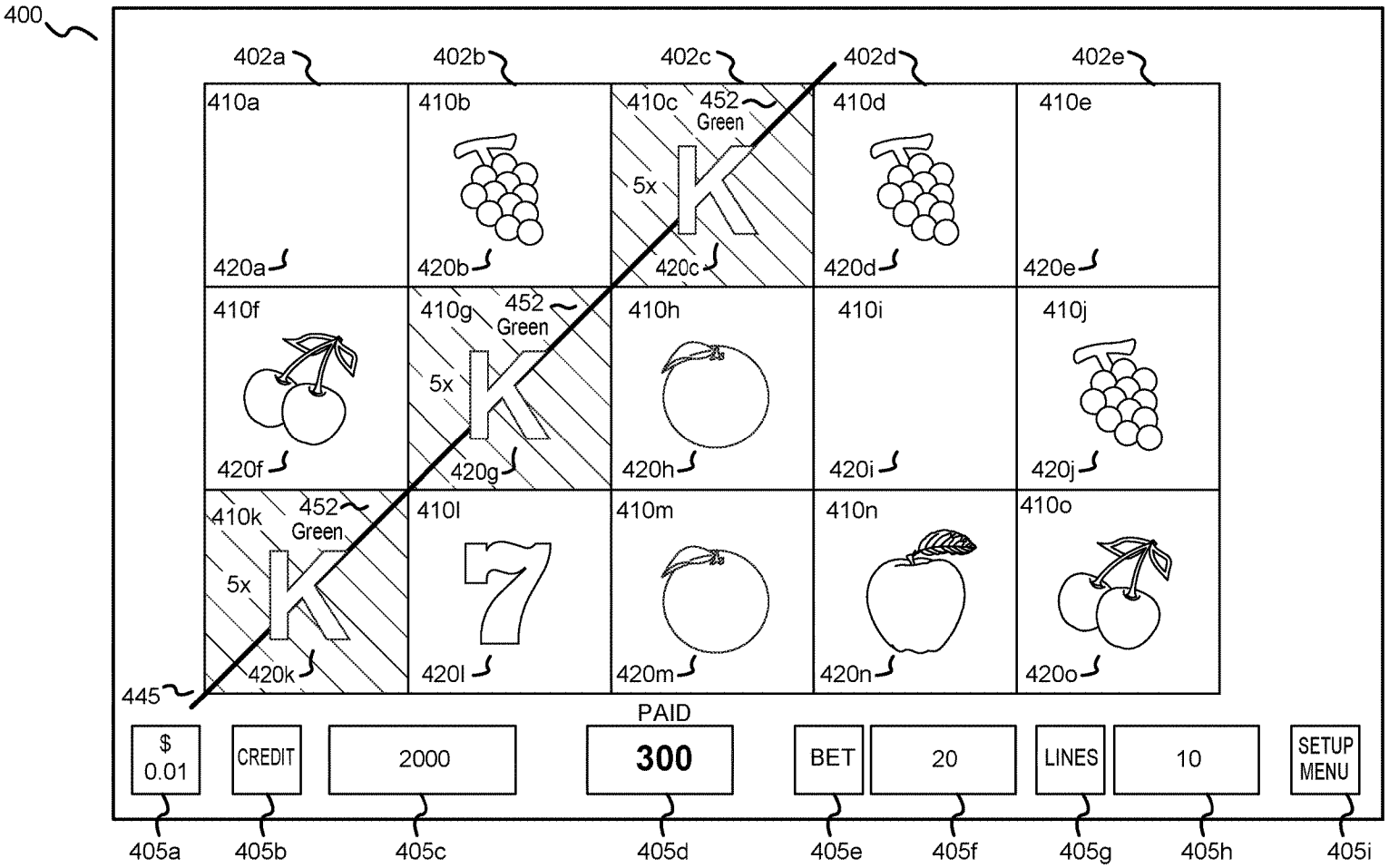

Turning to FIG. 4E, the gaming system continues cycling through the colored symbols from the secondary symbol set. In FIG. 4E, the gaming system replaced the previously displayed a Blue symbol 451 with Green symbol 452 in each of the symbol display areas associated with the winning symbol combination for King symbols. In this embodiment, the Green symbol 452 is shown associated with a 5× payout award enhancement.

Figure 4F:
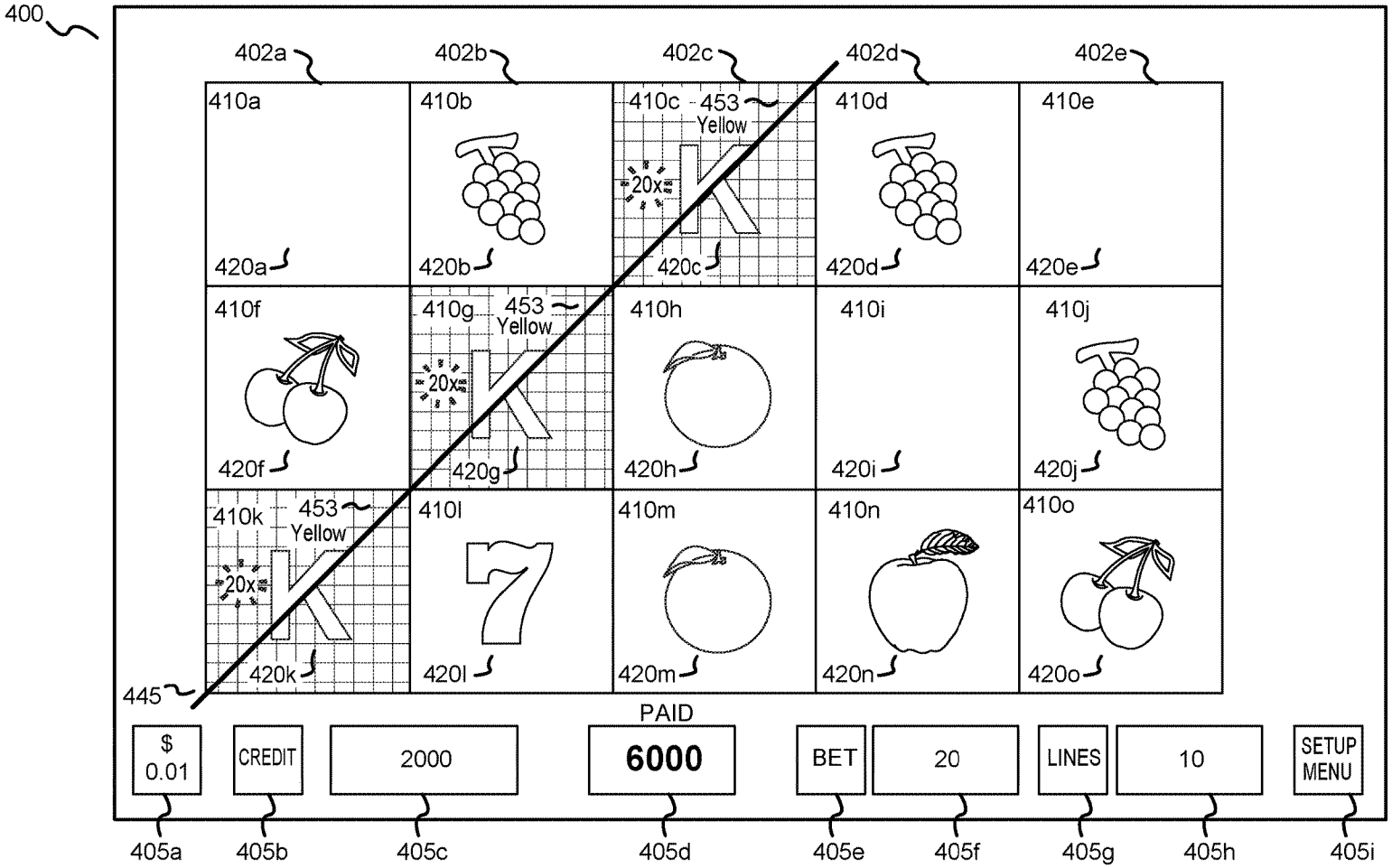

Turning to FIG. 4F, the gaming system completes cycling through the colored symbols from the secondary symbol set and displays the generated or selected colored symbol for the payout award enhancement. In FIG. 4F, the gaming system replaced the previously displayed a Green symbol 452 with Yellow symbol 453 in each of the symbol display areas associated with the winning symbol combination of King symbols. In this embodiment, the Yellow symbol 453 is shown associated with a very large 20× payout award enhancement. In some embodiments where the payout award enhancement value is shown with the colored symbol, the gaming system may further highlight the payout award enhancement value to the player. The gaming system calculates a second award based on the first payout award (300 credits) and the payout award enhancement value generated from the secondary symbol set. In this embodiment, gaming system multiplies the first payout award of 300 credits by the 20× multiplier to obtain a very large 6000 credit payout award. The gaming system further updated the information display area 405*d* to reflect the second award of 6000 credits. In some embodiments, the play of the game ends once the payout award enhancement process is complete. In some embodiments, such as discussed in connection with FIG. 3B, the gaming system may activate a bonus feature. In other embodiments, the player may start another play of the game or cash out.

It should be appreciated that the order of display of the color symbols during the cycling can be varied in any suitable manner.

Figure 4G:
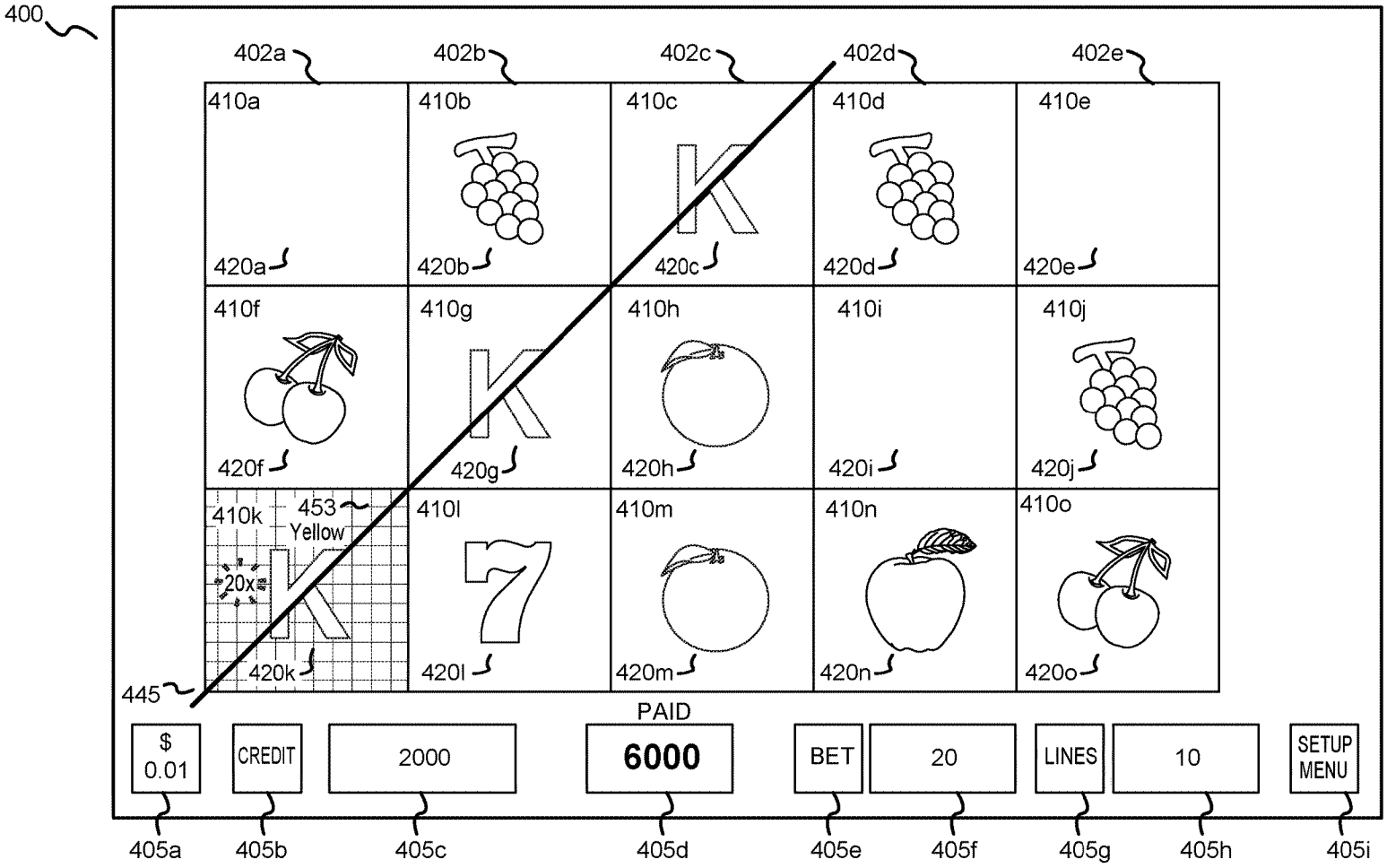

FIG. 4G illustrates an alternative embodiment where only one color symbol is displayed in one of the symbol display areas of the winning symbol combination. The gaming system may calculate the payout award enhancement in the same manner as FIG. 4F.

Figure 4H:
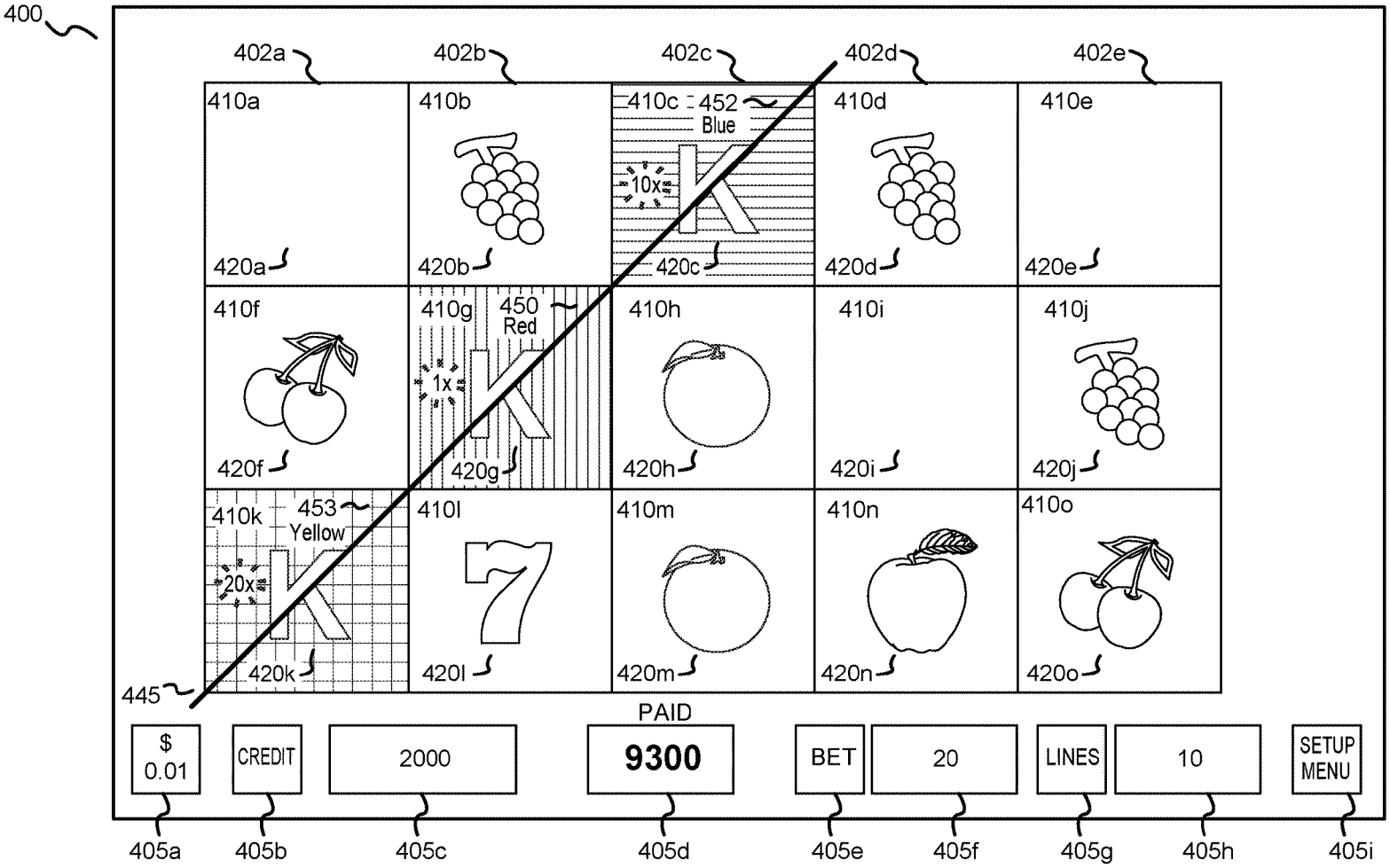

FIG. 4H illustrates an alternative embodiment where different colored symbols were generated and displayed in each of the symbol display areas of the winning symbol combination. The gaming system may generate the different colored symbols from the same secondary symbol set or a plurality of different secondary symbol sets. The gaming system may calculate the payout award enhancement in a number of different ways. For example, the gaming system may separately calculate the payout award enhancement associated with individual color symbols and sum the products (e.g., (300×20)+(300×1)+(300×10)=9300 credits) for the second payout award such as illustrated in information display area 405*d*. Alternatively, the gaming system may calculate the payout award enhancement associated with individual color symbols together (e.g., 300×20×1×10=60,000 credits), which is not shown in FIG. 4H.

Figure 4I:
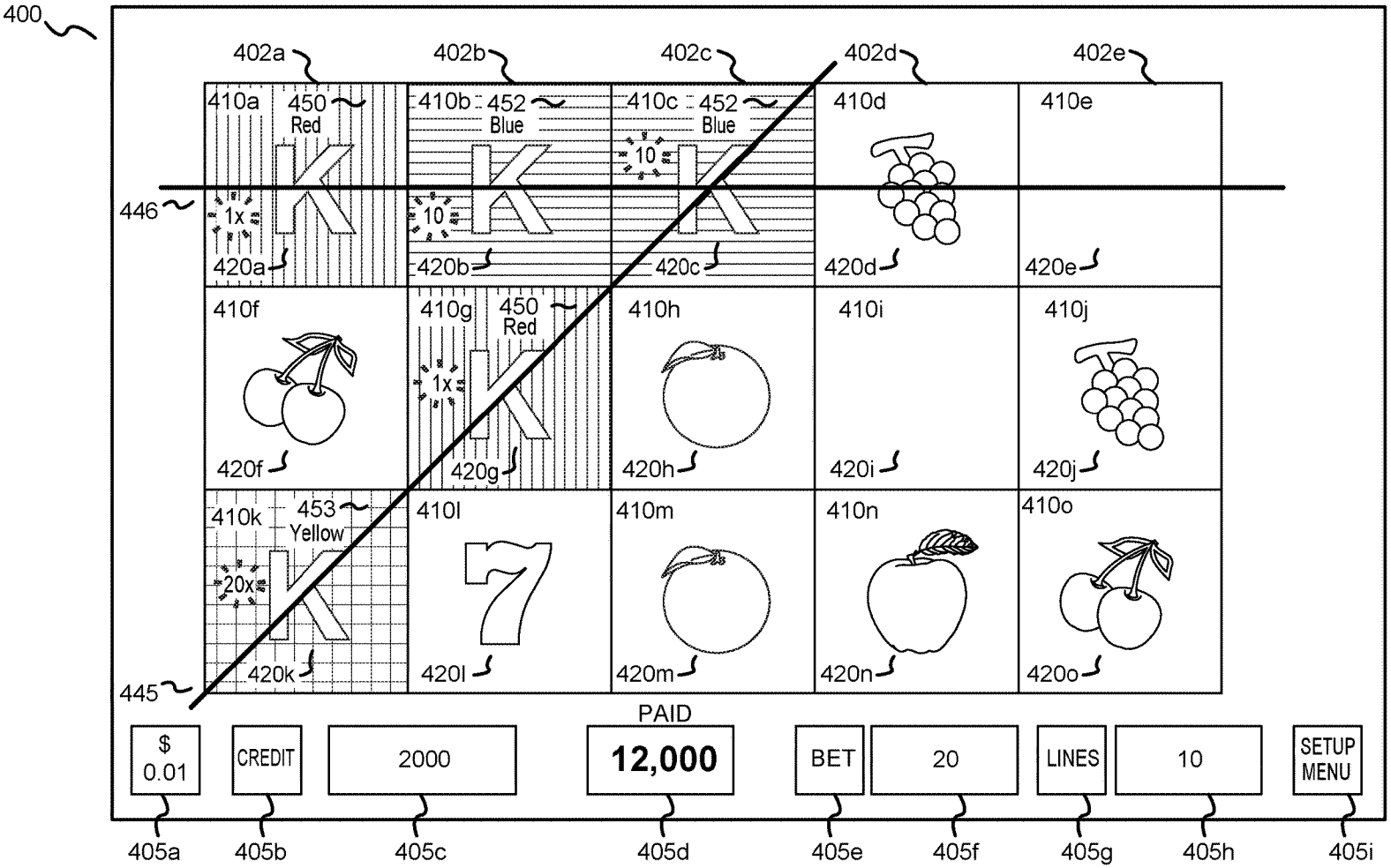

FIG. 4I illustrates another embodiment where the gaming system generated different colored symbols in association with different winning symbol combinations. As illustrated in FIG. 4I, the gaming system generated winning symbol combinations along pay line 445 and pay line 446 that overlap. The gaming system also generated different colored symbols for each of the symbol display areas 410*a*, 410*b*, 410*c*, 410*k*, and 410*g*. As noted above, the gaming system may calculate the second award for the payout award enhancement in a plurality of different ways. In some embodiments, the gaming system may generate more than one colored symbol for the same symbol display area. For example, symbol display area 410*c* forms part of the winning symbol combination along pay line 445 and another winning symbol combination along pay line 446. In some embodiments, the gaming system can generate the Blue symbol 452 in symbol display area 410*c* for the winning symbol combination along pay line 446. The gaming system may also generate another symbol, such as Yellow symbol in symbol display area 410*c* for the winning symbol combination along pay line 445 (not shown). In some embodiments, the gaming system may rotate displays of Blue symbol 452 and a Yellow symbol in symbol display area 410*c*. In other embodiments, the gaming system may divide the symbol display area into a plurality of segments such that both the Blue symbol and the Yellow symbol can be simultaneously displayed with the King symbol 420*c*. In some embodiments, the symbol display area can be divided in half to accommodate both colored symbols. In other embodiments, the gaming system can use a segmented display such as found in FIGS. 5B-5G to accommodate displaying a plurality of colored symbols for one symbol display area at substantially the same time. In alternative embodiments, the Blue symbol 452 in symbol display area 410*c* may be used to calculate two separate enhancement awards because it appeared associated with two different winning symbol combinations. It should be appreciated that generating a plurality of colored symbols for one symbol display area increases the potential payout award enhancement that the gaming system can generate for a player.

Figure 4J:
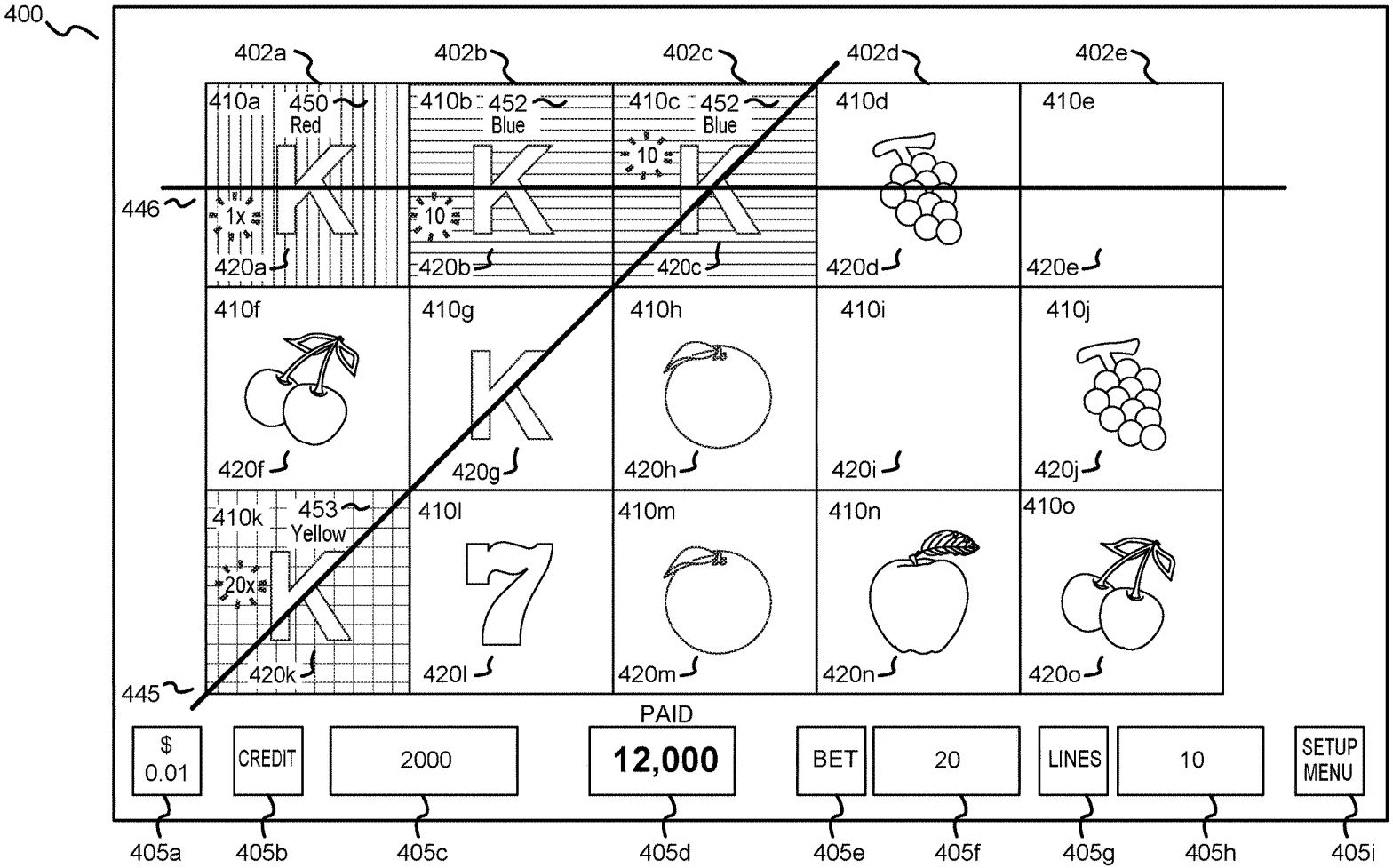

FIG. 4J illustrates still another embodiment where the gaming system generated different colored symbols and displayed different winning symbol combinations, but generated fewer colored symbols than the symbols in the winning symbol combination. As illustrated in FIG. 4J, the gaming system generated winning symbol combinations along pay line 445 and pay line 446 that overlap. The gaming system also generated a plurality of different colored symbols for each of the symbols display areas 410*a*, 410*b*, 410*c*, and 410*k*. Although symbol display area 410*g* is part of the winning symbol combination along pay line 445, the gaming system did not generate a colored symbol for symbol display area 410*g*.

FIGS. 5A-5G illustrate screen shots of one embodiment of a gaming system including a secondary symbol award enhancement delivered through a border symbol selection.

For the sake of brevity, the primary game in FIGS. 5A-5G may operate similar to the primary game discussed in FIG. 4A-4B. In alternative embodiments, the primary game can be a different game.

Figure 5A:
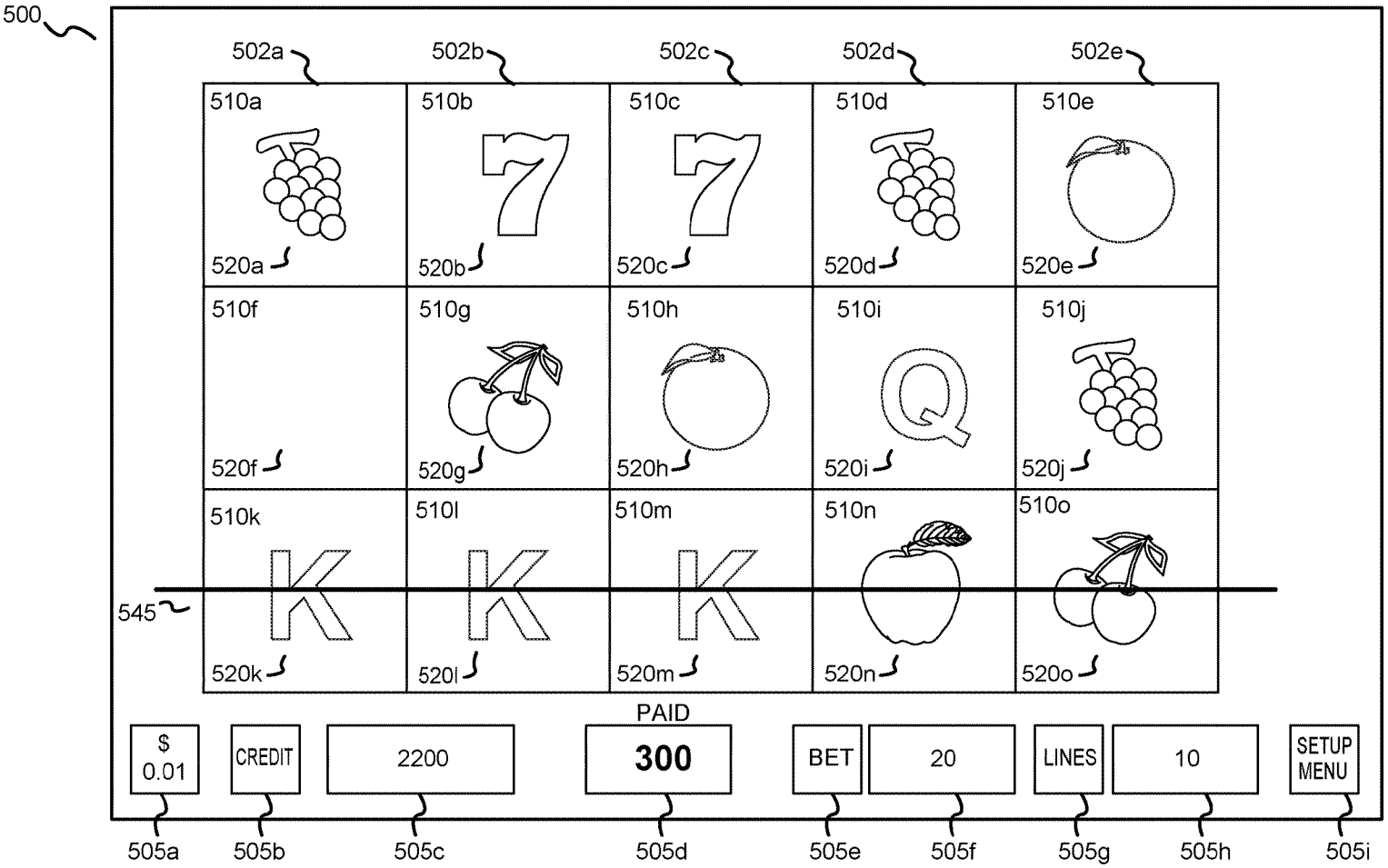
FIGS. 5A, 5B, 5C, 5D, 5E, 5F, and 5G illustrates one embodiment of a gaming system comprising a secondary symbol award enhancement.

Turning to FIG. 5A, the gaming system displays the generated symbols 520*a*-520*o* in symbol display areas 510*a*-510*o* as illustrated in FIG. 5A. Symbols 520*a*-520*o* displayed on reels 502*a*-502*e* illustrate the randomly generated symbols from the symbol set after the reels have stopped spinning. As illustrated in FIG. 5A, the gaming system randomly generated and displayed symbols 520*a*, 520*f*, and 520*k* in symbol display areas 510*a*, 510*f*, and 510*k* for reel 502*a*. The gaming system also randomly generated and displayed symbols 520*b*, 520*g*, and 520*l* in symbol display areas 510*b*, 510*g*, and 510*l* for reel 502*b*; symbols 520*c*, 520*h*, and 520*m* in symbol display areas 510*c*, 510*h*, and 510*m* for reel 502*c*; symbols 520*d*, 520*i*, and 520*n* in symbol display area 510*d*, 510*i*, and 510*n* for reel 502*d*; symbols 520*e*, 520*j*, and 520*o* in symbol display area 510*e*, 510*j*, and 510*o* for reel 502*e*.

FIG. 5A further illustrates one embodiment of a gaming system executing an evaluation of the generated symbols on reels 502*a*-502*e* for winning symbol combinations. As noted above, the player may have wagered on one or more pay lines (such as 10 pay lines shown in information area 505*h*). In one embodiment, at least the active (wagered on pay lines) are evaluated for winning symbol combinations. Any suitable number of pay lines may be used to evaluate winning symbol combinations.

In the embodiment illustrated in FIG. 5A, the gaming system evaluated the generated and displayed symbols for winning symbol combinations. In FIG. 5A, the gaming system determined that a winning symbol combination is displayed across one wagered pay line 545. The pay line spans across a horizontal direction of symbol display areas including symbol display areas 510*k*, 510*l*, and 510*m*. In this embodiment, the gaming system displayed three King symbols along the diagonal pay line 545 on which the player had placed a wager. The gaming system determined the three King symbols form a winning symbol combination based on a pay table (not shown) associated with the gaming system. The winning pay line is illustrated as pay line 545 in FIG. 5A across the adjacent row of reels 502*a*-502*c*. The gaming system also updated information area 505*d* to illustrate that the player won 300 credits for the winning symbol combination of three King symbols.

As noted in connection with FIG. 3B and FIGS. 4A and 4B, the gaming system may evaluate the winning symbol combination to determine if a payout award enhancement process has been triggered.

Figure 5B:
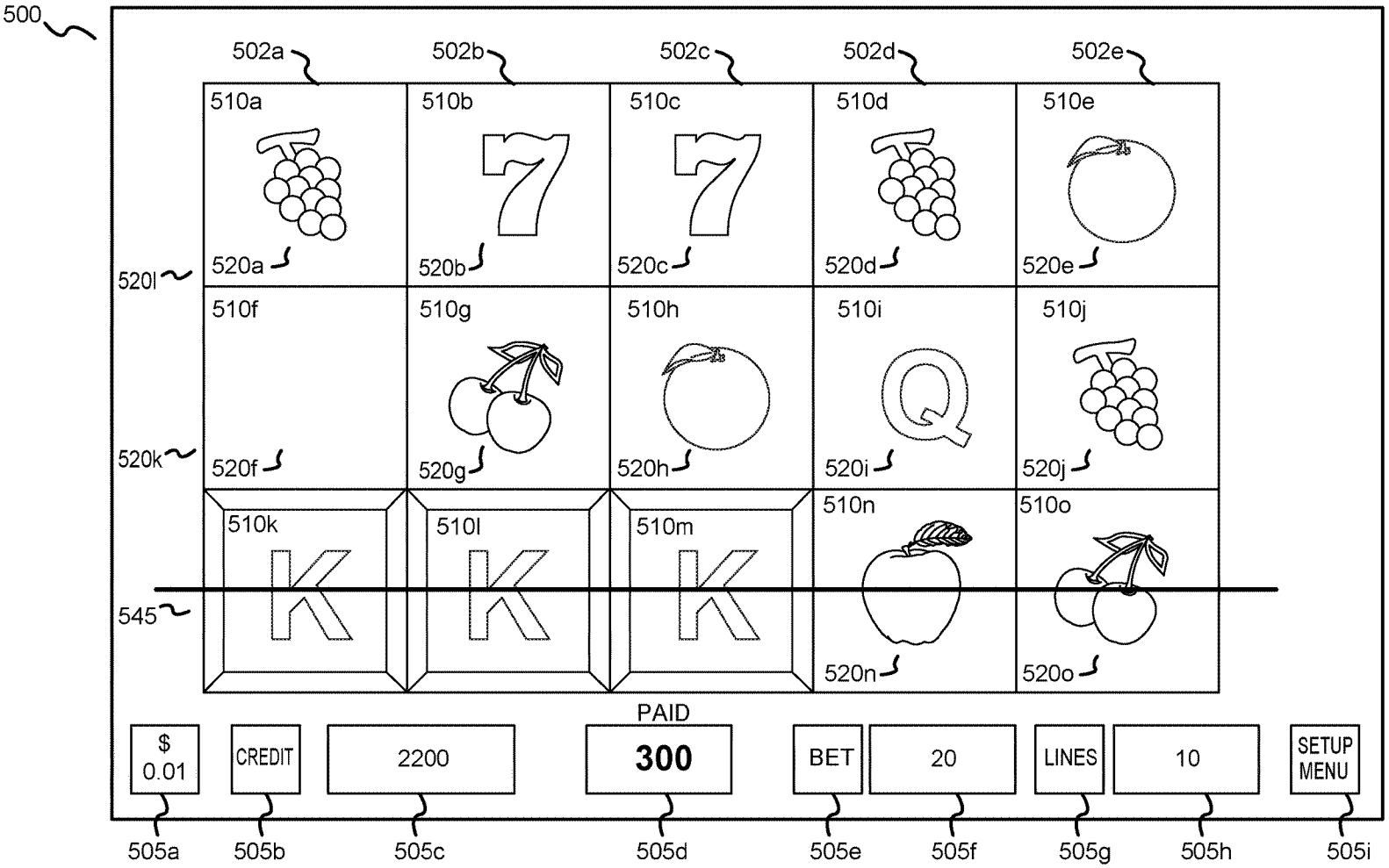

As shown in FIG. 5B, the gaming system determined that the payout award enhancement process was trigged in connection with the three winning King symbols in symbol display areas 510*k*, 510*l*, and 510*m*. In contrast to FIG. 4A-4J, in the illustrated embodiment of FIG. 5B, the gaming system generated a border around the symbol display areas of the winning symbol combinations. The gaming system uses the border to display the secondary symbols from a secondary symbol set. Like in FIG. 4A-4J, the secondary symbols may comprise color symbols. In some embodiments, the border may be continuous such that the gaming system displays one secondary symbol in a border at a time. In alternative embodiments, the border may be segmented as illustrated in FIG. 5B such that more than one secondary symbol can be display at a time. It should be appreciated that even when the border is segmented, the gaming system may display one secondary symbol throughout the segmented border. In other embodiments, as will be discussed below, the gaming system may display one secondary symbol in one border segment associated with one symbol display area at a time. In some embodiments, each secondary symbol is associated with one of the border segments. In other embodiments, the secondary symbols are not associated with any particular border segment (which enables the gaming system to generate any secondary symbol in any of the border segments).

As with FIG. 4C-4F, the gaming system in FIG. 5B-5G may cycle through or flash a plurality of secondary symbols from a secondary symbol set in the border areas. Each of the secondary symbols is associated with a payout award enhancement. In one embodiment, as illustrate in FIGS. 5C-5G, the plurality of symbols are color symbols. In FIGS. 5C-5G, the secondary symbol set includes color symbols Red, Green, Blue, and Yellow. It should be appreciated that any suitable color and any suitable quantity of different colors may be used. Each of the colors may be associated with a payout award enhancement such as found in pay table 600 of FIG. 6. However, in some embodiments, the payout award enhancement value may result in no enhancement (e.g., 1× or a zero value). In some embodiments, the color symbols are weighted such that the gaming system has a different probability of generating different color symbols. In some embodiments, the color symbols are weighted independent of a pay line or symbols display area. In other embodiments, the color symbols are weighted differently based on the pay line of the winning symbol combination or the associated symbol display areas.

Figure 5C:
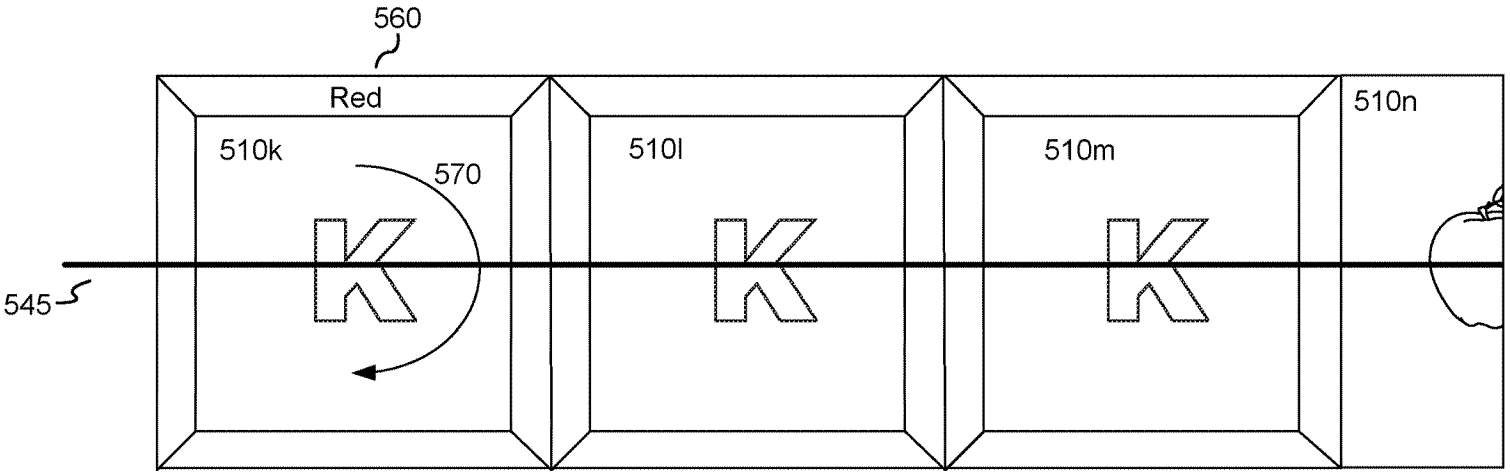

Turning to FIG. 5C, a close up of the symbol display areas 510*k*, 510*l*, and 510*m* with the secondary symbol border are illustrated. The gaming system begins cycling through the colored symbols from the secondary symbol set. In FIG. 5C, the gaming system first displayed a Red symbol 560 in one border segment of the symbol display area 510*k*. In alternative embodiments, the gaming system may display only a Red symbol 560 in each of the border areas of symbol display areas 510*k*, 510*l*, and 510*m*, such as in situations where the gaming system uses one payout award enhancement value no matter how many Red symbols 560 are displayed. In other embodiments using a plurality of secondary symbol sets, the gaming system may generate the same or different color symbols for more than one of the symbol display areas 510*k*, 510*g*, and 510*c*. Each of the separately generated color symbols may be used to formulate a second payout award (based on the first payout award of 300 and the payout award enhancement values(s)). As also illustrated in FIG. 5C, direction arrow 570 shows the direction that the gaming system will use to display successive color symbols in the border segments of symbol display area 510*k*. It should be appreciated that any direction or a random selection of border segments can be used to display the next color symbol.

In some embodiments, the gaming system may display the payout award enhancement value associated with the displayed color symbol to excite the player. However, the payout award enhancement value may not be displayed in other embodiments. In some embodiments, the color symbols are displayed for a predetermined period of time (e.g., ½ a second). However any suitable time period can be used. In some embodiments, the time period varies. For example, the color symbols can be displayed for very short periods of time initially, but as the gaming system cycles through the color symbols, the gaming system may begin to increase the amount of time each color symbol is displayed. In some embodiments, the display frequency of different colored symbols may correspond to the physics of spinning a physical wheel. The gaming system may appear to flash the color symbols in the border segments of the symbol display areas.

In some embodiments, each border segment of the symbol display areas may display a color symbol at the same or substantially the same time. In some such embodiments, the gaming system may lighten or darken a particular color symbol to show the gaming system cycling through the color symbol. Other suitable mechanisms to highlight a particular color symbol around a border area can be used.

Figure 5D:
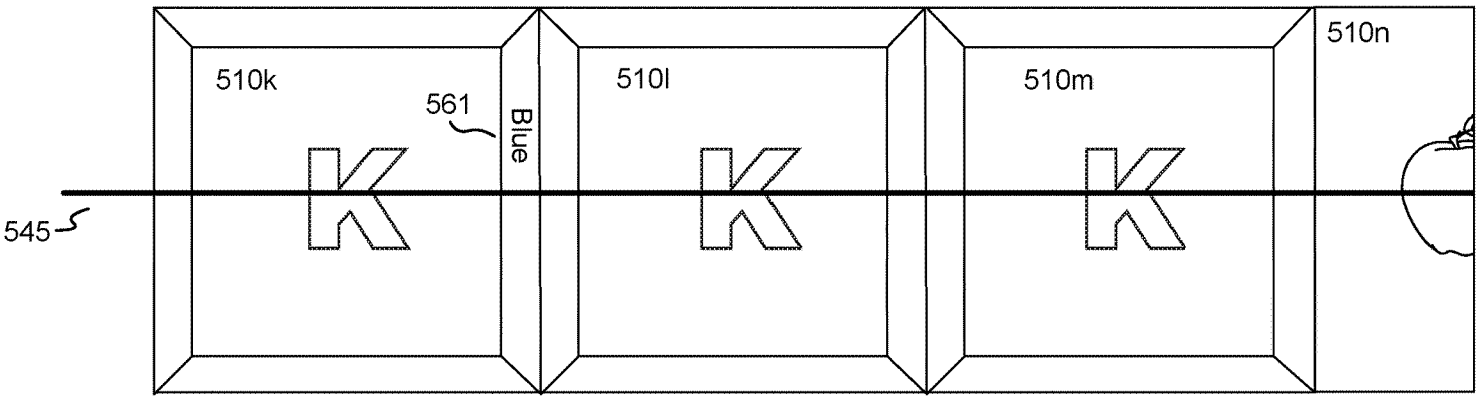

Turning to FIG. 5D, the gaming system continues cycling through the colored symbols from the secondary symbol set. In FIG. 5D, the gaming system removes the initially displayed Red symbol 560 in one border segment and displays Blue symbol 561 in an adjacent border segment of symbol display area 510*k*. In alternative embodiments, each displayed color symbol may remain displayed. It should be appreciated that the color symbols and the King symbols are displayed in the same symbol display areas at substantially the same time. In this embodiment, the Blue symbol 561 is associated with a 10× payout award enhancement in accordance with the associated pay table 600 in FIG. 6.

Figure 5E:
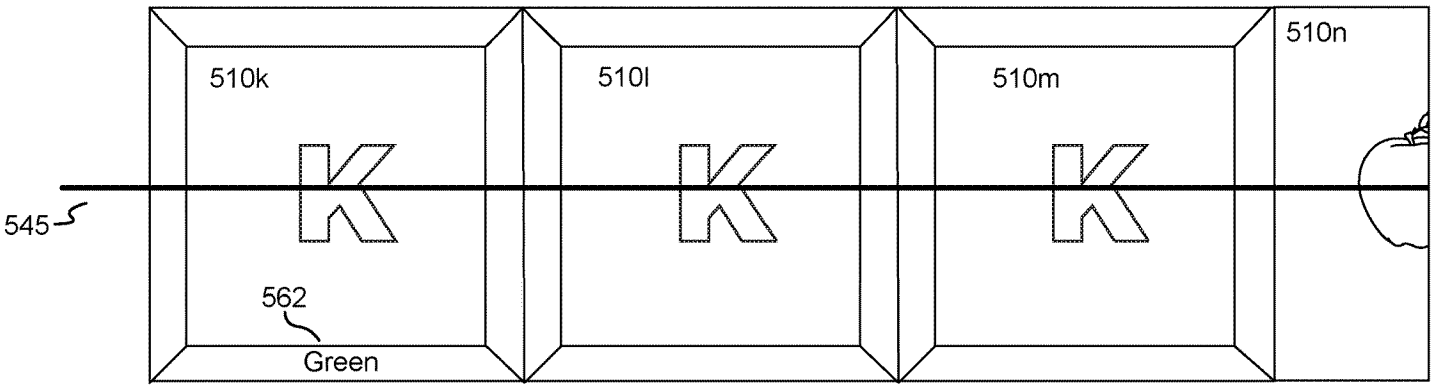

Turning to FIG. 5E, the gaming system continues cycling through the colored symbols from the secondary symbol set. In FIG. 5E, the gaming system removes the previously displayed Blue symbol 561 in one border segment. The gaming system displays Green symbol 562 in an adjacent border segment of symbol display area 510*k*. In this embodiment, the Green symbol 562 is associated with a 1× (or 0 value) payout award enhancement in accordance with the associated pay table 600 in FIG. 6.

Figure 5F:
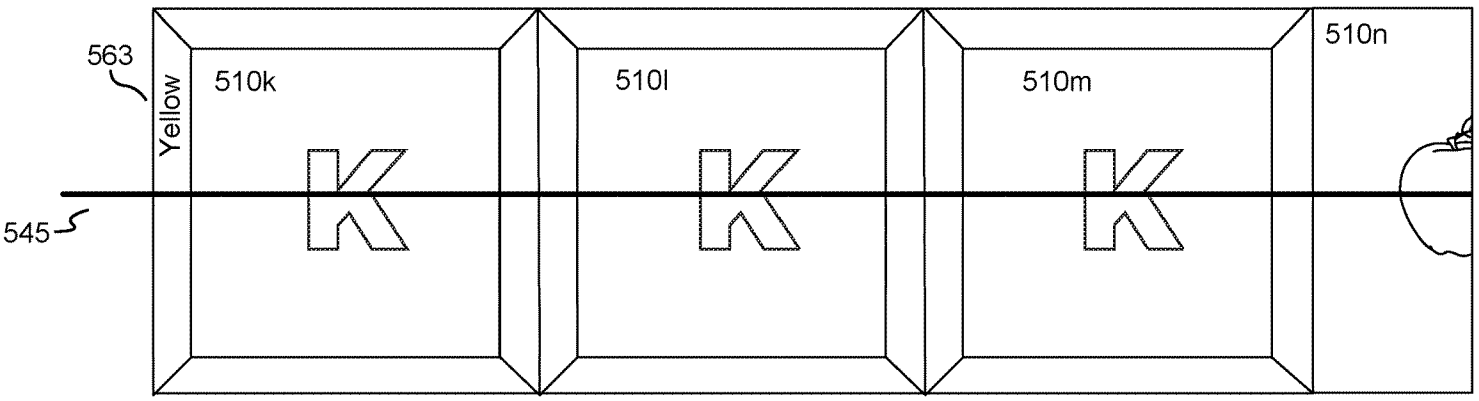
Figure 5G:
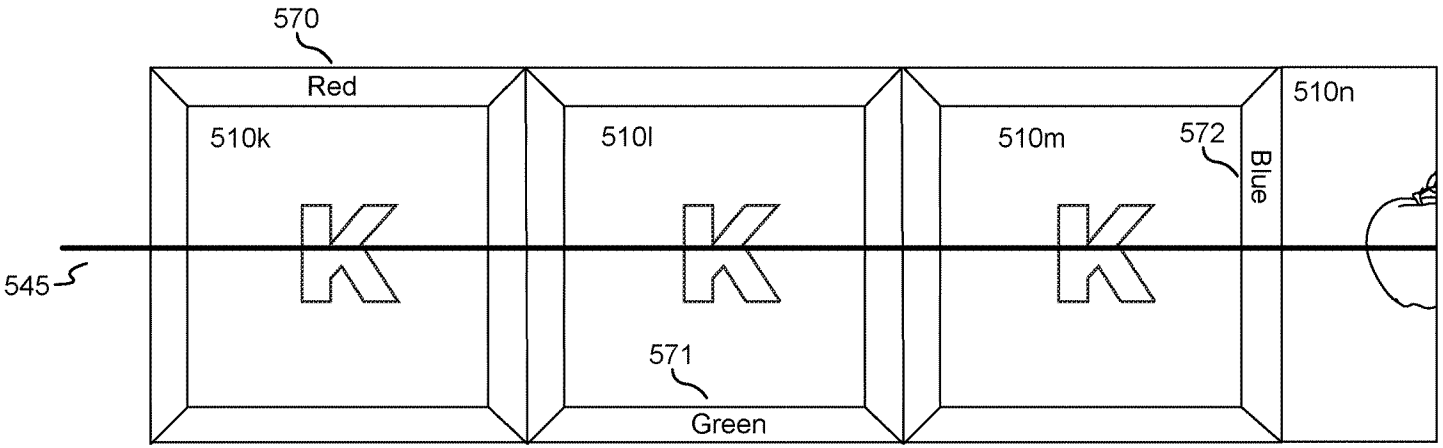

Turning to FIG. 5F, the gaming system completes cycling through the colored symbols from the secondary symbol set and displays the generated or selected colored symbol for the payout award enhancement. In FIG. 5F, the gaming system removed the previously displayed Green symbol 562 in one border segment. The gaming system displays Yellow symbol 563 in an adjacent border segment of symbol display area 510*k*. In this embodiment, the Yellow symbol 563 is associated with a 2× payout award enhancement. In some embodiments where the payout award enhancement value is shown with the colored symbol, the gaming system may further highlight the payout award enhancement value to the player. The gaming system calculates a second award based on the first payout award (300 credits) and the payout award enhancement value generated from the secondary symbol set. In this embodiment, gaming system multiplies the first payout award of 300 credits by the 2× multiplier to obtain a large 600 credit enhanced payout award. The gaming system further updated the information display area 405*d* to reflect the second award of 600 credits (not shown). In some embodiments, the play of the game ends once the payout award enhancement process is complete. In some embodiments, such as discussed in connection with FIG. 3B, the gaming system may activate a bonus feature. In other embodiments, the player may start another play of the game or cash out.

It should be appreciated that the order of display of the color symbols during the cycling can be varied in any suitable manner.

FIG. 5H illustrates an alternative embodiment where different colored symbols were generated and displayed in different border segments for each of the symbol display areas of the winning symbol combination. The gaming system may generate the different colored symbols from the same secondary symbol set or a plurality of different secondary symbol sets. The gaming system may calculate the payout award enhancement in a number of different ways. For example, the gaming system may separately calculate the payout award enhancement associated with individual color symbols and sum the products for the second payout award (e.g., (300×5)+(300×1)+(300×10)=4800 credits) based on the pay table from FIG. 6). Alternatively, the gaming system may calculate the payout award enhancement associated with individual color symbols together (e.g., 300×5×1×10=15,000 credits).

While not shown, it should be appreciated that the gaming system may generate the segmented border around each symbol display area associated with a winning symbol combination. Alternatively, the gaming system may selectively generate the segmented border around certain symbol display areas associated with a winning symbol combination. The gaming system may display the segmented border areas around symbol display areas in other suitable variations.

It should therefore be appreciated that a gaming system and method with secondary symbols to enhance payout awards creates new and exciting ways for the gaming system to generate awards and enable a player to improve awards associated with winning symbol combinations. The ability to enhance low payout awards or further improve large payout awards creates a new potential to earn greater awards and improves the sense of anticipation for players using the gaming system and method.

A number of embodiments of the invention have been described. Various modifications may be made without departing from the spirit and scope of the invention. For example, various forms of the flows shown above may be used, with steps re-ordered, added, or removed. Accordingly, other embodiments are within the scope of the following claims.

I claim:

1. A gaming system comprising:

a cabinet;

a processor;

a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

place a wager following receipt of a wager input via the input device, the credit balance being decreased by the wager;

display, on the display device, a plurality of randomly generated first symbols from a first symbol set, where each of the plurality of randomly generated first symbols is displayed in an associated first symbol display area;

display, on the display device, a plurality of border segments around one of the associated first symbol display areas;

display, on the display device, a first award based on any winning symbol combinations formed from the plurality of randomly generated first symbols;

if a winning symbol combination was generated, generate at least one secondary symbol from a secondary symbol set, the secondary symbol set comprising a plurality of different symbols, wherein each of the plurality of different symbols is associated with one of the plurality of border segments;

display, on the display device, the generated at least one secondary symbol, where the generated at least one secondary symbol is displayed in the associated one of the plurality of border segments in one of the first symbol display areas associated with one of the randomly generated first symbols that formed the winning symbol combination;

determine an award enhancement associated with the generated at least one secondary symbol;

calculate a second award based on the first award and the award enhancement associated with the generated at least one secondary symbol;

display, on the display device, the second award, the credit balance being increased by the second award; and issue value from the value dispenser based on the credit balance upon receipt of a cash out signal via the input device.

2. The gaming system of claim 1, wherein the plurality of different symbols of the secondary symbol set comprises a plurality of different color symbols.

3. The gaming system of claim 2, wherein each of the plurality of different color symbols is associated with one of a plurality of award enhancements.

4. The gaming system of claim 3, wherein the plurality of award enhancements comprise multiplier awards.

5. The gaming system of claim 2, wherein the processor displays a plurality of the plurality of different color symbols from the secondary symbol set before generating the at least one secondary symbol.

6. The gaming system of claim 2, wherein the processor displays a plurality of the plurality of different color symbols from the secondary symbol set while generating the at least one secondary symbol.

7. The gaming system of claim 1, wherein if the winning symbol combination was generated, generate a secondary symbol for a plurality of randomly generated first symbols in the winning symbol combination.

8. The gaming system of claim 7, wherein each generated secondary symbol is selected from one secondary symbol set.

9. The gaming system of claim 7, wherein each generated secondary symbol is selected from a different secondary symbol set.

10. The gaming system of claim 1, further comprising a plurality of secondary symbol sets.

11. The gaming system of claim 10, wherein if the winning symbol combination was generated, generate a secondary symbol for each randomly generated first symbol in the winning symbol combination from one of the plurality of secondary symbol sets.

12. The gaming system of claim 1, wherein if the winning symbol combination was generated, generate a secondary symbol for each randomly generated first symbol in the winning symbol combination, wherein a plurality of generated secondary symbols are associated with different award enhancements.

13. The gaming system of claim 1, wherein generating the at least one secondary symbol from the secondary symbol set is based on the winning symbol combination being generated on an active pay line.

14. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

displaying, on a display device in the housing of the gaming system, a plurality of randomly generated first symbols from a first symbol set, where each of the plurality of randomly generated first symbols is displayed in an associated first symbol display area;

display, on the display device, a plurality of border segments around one of the associated first symbol display areas;

displaying, on the display device, a first award based on any winning symbol combinations formed from the plurality of randomly generated first symbols;

if a winning symbol combination was generated, generating, with the processor, at least one secondary symbol from a secondary symbol set, the secondary symbol set comprising a plurality of different symbols, wherein each of the plurality of different symbols is associated with one of the plurality of border segments;

displaying, on the display device, the generated at least one secondary symbol, where the generated at least one secondary symbol is displayed in the associated one of the plurality of border segments in one of the associated first symbol display areas associated with one of the randomly generated first symbols that formed the winning symbol combination;

determining an award enhancement associated with the generated at least one secondary symbol;

calculating, with the processor, a second award based on the first award and the award enhancement associated with the generated at least one secondary symbol;

displaying, on the display device, the second award, the credit balance being increased by the second award; and issuing another monetary value, by a monetary value dispenser, based on the credit balance upon receipt of a cash out signal via an input device of the gaming system.

15. A non-transitory computer-readable storage medium having machine instructions stored therein, the instructions being executable by a processor to cause the processor to:

establish a credit balance based at least in part on a monetary value received by a value acceptor of a gaming device;

place a wager following receipt of a wager input via an input device, the credit balance being decreased by the wager;

display, on a display device of the gaming device, a plurality of randomly generated first symbols from a first symbol set, where each of the plurality of randomly generated first symbols is displayed in an associated first symbol display area;

display, on the display device, a plurality of border segments around one of the associated first symbol display areas;

display, on the display device, a first award based on any winning symbol combinations formed from the plurality of randomly generated first symbols;

if a winning symbol combination was generated, generate at least one secondary symbol from a secondary symbol set, the secondary symbol set comprising a plurality of different symbols, wherein each of the plurality of different symbols is associated with one of the plurality of border segments;

display, on the display device, the generated at least one secondary symbol, where the generated at least one secondary symbol is displayed in the associated one of the plurality of border segments in one of the associated first symbol display areas associated with one of the randomly generated first symbols that formed the winning symbol combination;

determine an award enhancement associated with the generated at least one secondary symbol;

calculate a second award based on the first award and the award enhancement associated with the generated at least one secondary symbol;

display, on the display device, the second award, the credit balance being increased by the second award; and issue value from a value dispenser based on the credit balance upon receipt of a cash out signal via the input device.

* * * * *